US007334888B2

(12) United States Patent
Sasaki et al.

(10) Patent No.: US 7,334,888 B2
(45) Date of Patent: Feb. 26, 2008

(54) INK CARTRIDGE

(75) Inventors: Toyonori Sasaki, Anjo (JP); Shingo Hattori, Tsushima (JP); Tomohiro Kanbe, Bisai (JP); Atsuhiro Takagi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 347 days.

(21) Appl. No.: 10/991,852

(22) Filed: Nov. 19, 2004

(65) Prior Publication Data

US 2005/0134663 A1 Jun. 23, 2005

(30) Foreign Application Priority Data

| | | |
|---|---|---|
| Nov. 25, 2003 | (JP) | 2003-394323 |
| Nov. 25, 2003 | (JP) | 2003-394324 |
| Dec. 8, 2003 | (JP) | 2003-409077 |
| Dec. 8, 2003 | (JP) | 2003-409640 |
| Feb. 9, 2004 | (JP) | 2004-031712 |
| Feb. 10, 2004 | (JP) | 2004-032872 |
| Feb. 20, 2004 | (JP) | 2004-043978 |
| Feb. 24, 2004 | (JP) | 2004-047768 |
| Feb. 27, 2004 | (JP) | 2004-053164 |
| Mar. 4, 2004 | (JP) | 2004-060456 |

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS

| | | | | |
|---|---|---|---|---|
| 5,506,611 | A | 4/1996 | Ujita et al. | |
| 5,949,456 | A * | 9/1999 | Matsumoto et al. | 347/85 |
| 6,062,667 | A | 5/2000 | Matsui et al. | |
| 6,241,348 | B1 | 6/2001 | Haigo | |
| 6,312,084 | B1 | 11/2001 | Ujita et al. | |
| 6,511,168 | B2 | 1/2003 | Higuma | |
| 6,666,550 | B2 * | 12/2003 | Sasaki | 347/85 |
| 6,786,581 | B1 | 9/2004 | Shinada et al. | |
| 6,846,062 | B2 | 1/2005 | Harada et al. | |
| 6,854,836 | B2 * | 2/2005 | Ishinaga et al. | 347/85 |
| 6,886,927 | B2 * | 5/2005 | Shinada et al. | 347/86 |
| 6,929,357 | B2 * | 8/2005 | Qingguo et al. | 347/85 |

(Continued)

FOREIGN PATENT DOCUMENTS

EP 1 000 753 A1 5/2000

(Continued)

*Primary Examiner*—Hai Pham
*Assistant Examiner*—Kainoa Wright
(74) *Attorney, Agent, or Firm*—Oliff & Berridge, PLC

(57) ABSTRACT

An ink cartridge includes an ink chamber; a communication chamber that is capable of communicating with the ink chamber; a valve that is movable; a support disposed within the communication chamber, the support including a valve seat and an opening exposing a bottom of the valve at an approximately central portion, wherein the valve seat is adjacent to the valve at an outer periphery of the opening; and an urging device that extends from the valve seat, the urging device directly contacting the valve and urging the valve toward the valve seat, wherein the valve separates from the valve seat when a predetermined force is applied to the valve and the support and the urging device are formed as a one-piece member.

27 Claims, 20 Drawing Sheets

U.S. PATENT DOCUMENTS

| | | | |
|---|---|---|---|
| 2001/0048456 | A1 | 12/2001 | Higuma |
| 2002/0060725 | A1 | 5/2002 | Shinada et al. |
| 2003/0001920 | A1 | 1/2003 | Harada et al. |
| 2003/0016265 | A1 | 1/2003 | Harada et al. |
| 2004/0233260 | A1 | 11/2004 | Shinada et al. |

FOREIGN PATENT DOCUMENTS

| | | | |
|---|---|---|---|
| EP | 1 043 161 | A1 | 10/2000 |
| EP | 1 147 903 | A1 | 10/2001 |
| JP | A 3-197052 | | 8/1991 |
| JP | A 9-20018 | | 1/1997 |
| JP | A 11-58775 | | 3/1999 |
| JP | A-2001-1536 | | 1/2001 |
| JP | A 2001-113723 | | 4/2001 |
| JP | A-2002-1988 | | 1/2002 |

* cited by examiner

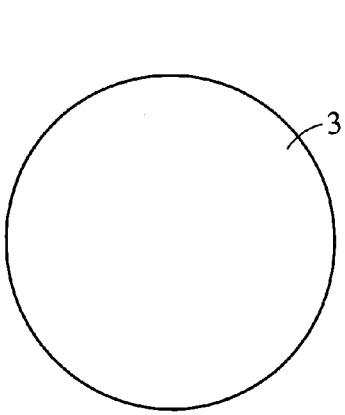
FIG. 6D
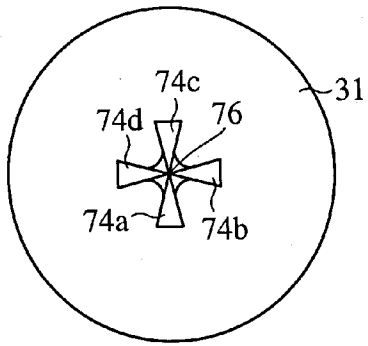
FIG. 6E
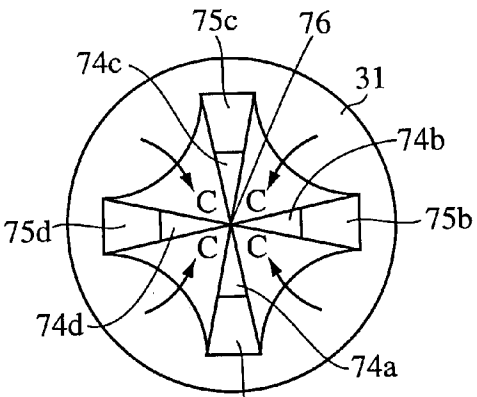
FIG. 6F
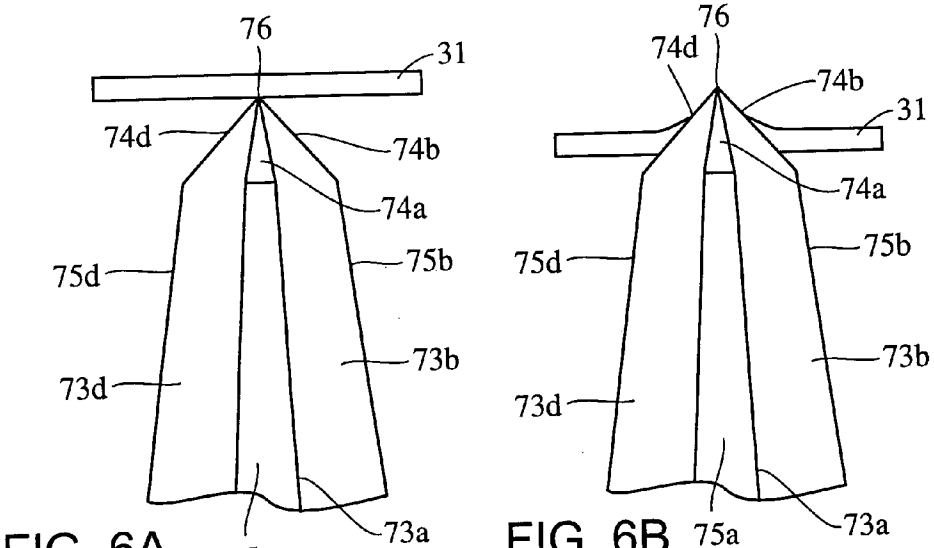
FIG. 6C
FIG. 6B
FIG. 6A

INK CARTRIDGE

INCORPORATION BY REFERENCE

This application claims priority from Japanese Patent Application No. 2003-394324, filed Nov. 25, 2003, Japanese Patent Application No. 2003-394323, filed Nov. 25, 2003, Japanese Patent Application No. 2003-409077, filed Dec. 8, 2003, Japanese Patent Application No. 2003-409640, filed Dec. 8, 2003, Japanese Patent Application No. 2004-031712, filed Feb. 9, 2004, Japanese Patent Application No. 2004-032872, filed Feb. 10, 2004, Japanese Patent Application No. 2004-043978, filed Feb. 20, 2004, Japanese Patent Application No. 2004-047768, filed Feb. 24, 2004, Japanese Patent Application No. 2004-053164, filed Feb. 27, 2004, and Japanese Patent Application No. 2004-060456, filed Mar. 4, 2004, the subject matter of those applications is incorporated herein by reference in its entirety.

BACKGROUND OF THE INVENTION

1. Field of Invention

This invention relates to an ink cartridge and an inkjet recording apparatus equipped with the ink cartridge.

2. Description of Related Art

An ink cartridge is typically loaded into an inkjet recording apparatus by mounting the ink cartridge into the inkjet recording apparatus. A rubber stopper is attached to the ink cartridge and prevents air, ink or any other material from entering or exiting the ink cartridge. The inkjet recording apparatus includes a hollow needle with an acuminate tip. When the ink cartridge is pushed and loaded into the inkjet recording apparatus, the hollow needle penetrates the stopper plug so that an inside of the ink cartridge is in communication with the hollow needle in order to supply ink to the inkjet recording apparatus. However, the acuminate tip of the hollow needle is formed with the acuminate tip projecting toward the user. It is thus necessary to employ safety measures in order to prevent a user from touching the tip.

In Japanese Unexamined Patent Application Publication H3-197052, for example, an inkjet recording apparatus is equipped with a protection device that protects the user from the hollow needle when the hollow needle is exposed. The protection device has a protection plate installed between the hollow needle and a side in which the ink cartridge is inserted in order to cover the hollow needle. When the ink cartridge is loaded, a lock of the protection plate when the protection plate is in a shielding position is released and the hollow needle is exposed. Furthermore, the hollow needle penetrates the stopper plug and the ink cartridge is thus loaded in the inkjet recording apparatus. Furthermore, when the ink cartridge is removed, the protection plate is placed in the shielding position by a twisted coil spring and held at that position by a lock component. Thus, the protection plate shields the user from touching the hollow needle.

As disclosed in Japanese Unexamined Patent Application No. 2001-113723, there also exist ink cartridges that prevent ink from leaking from the cartridges when the cartridges are removed from inkjet recording devices. Such ink cartridges are provided with an ink chamber that stores ink, an ink supply port that externally supplies ink stored in the ink chamber, and an ink guidance chamber formed between the ink chamber and the ink supply port.

The ink guidance chamber houses a valve unit, and a cylindrical packing is inserted into the ink supply port. The valve unit is urged by a compression spring in a direction elastically contacting the cylindrical packing in order to obstruct the ink flow path, and the valve unit prevents ink from leaking from the ink chamber side. The ink cartridge is structured such that, when attached to an inkjet recording device, an ink supply needle penetrates the cylindrical packing and opposes the urging force of the compression spring to press the valve unit toward the ink chamber. An ink flow path is thereby formed in order to supply ink.

There also exist ink cartridges, for example, in Japanese Laid-Open Patent Application No. 9-20018, in which the color of ink stored in the ink cartridge is easily recognized. Such ink cartridges include container bodies including porous materials into which ink is absorbed, and cover members that cover top openings of the containers. The cover members are formed of materials that are the same color as the ink absorbed by the porous materials. Therefore, even when ink cartridges of multiple colors are installed, because installation can be performed by recognizing the color of cover members of those ink cartridges, misinstallation of ink cartridges of different colors can be prevented. In addition, in order to recognize the color of the ink in the ink cartridge, ink cartridges formed from transparent or semi-transparent materials are also known.

There also exist ink cartridges, for example, in Japanese Laid-Open Patent Application 11-58775, to which a deaerating processing has been performed in order to store deaerated ink. The ink cartridge is included within a packaging body and the packaging body is held in a pressure-reduced state. The packaging body is held in a pressure-reduced state in order to suppress the deterioration of the deaerated ink while the ink cartridge is transported.

The inside of the ink cartridge is also divided into two spaces by a partition wall. Within the two spaces divided by the partition wall, one space is used as an ink supply chamber that temporarily stores ink that is supplied from an ink supply hole, and another space is used as an ink chamber that is filled by a porous member that can store ink. In order to store a large amount of ink, the ink chamber requires more space than the ink supply chamber. Because of this, the partition wall is arranged at a position that is significantly closer to an opposite end wall of the ink supply chamber.

SUMMARY OF THE INVENTION

In the ink cartridge in Japanese Unexamined Patent Application No. 2001-113723, for example, where the leakage of ink is prevented as described above, there is provided a switching valve unit which opens and obstructs the ink flow path and a compression spring which urges the valve unit. Thus, an ink guidance chamber is required in order to attach the valve unit. Furthermore, the compression spring must be formed between the ink supply port and the ink chamber. The structure for forming an ink flow path thus becomes complex. Because the valve unit and the compression spring are attached within the ink guidance chamber, the attachment operation becomes difficult, requiring further manufacturing steps. Consequently, high manufacturing costs are required to produce the ink cartridge.

Additionally, a compression spring made from metal is used. When recycling, a metal compression spring cannot be discarded together with the ink cartridge which is constructed from resin materials. Thus, when disposing of an ink cartridge, it is first necessary to disassemble the ink cartridge and remove the compression spring. As a result, the use of a metal compression spring entails problems in that the complexity of discarding an ink cartridge is increased, and disposal costs also become high.

The present invention allows, among other things, a reduction in manufacturing costs and a reduction in disposal costs.

In exemplary embodiments, an ink cartridge includes an ink chamber; a communication chamber that is capable of communicating with the ink chamber; a valve that is movable; a support disposed within the communication chamber, the support including a valve seat and an opening exposing a bottom of the valve at an approximately central portion, wherein the valve seat is adjacent to the valve at an outer periphery of the opening; and an urging device that extends from the valve seat, the urging device directly contacting the valve and urging the valve toward the valve seat, wherein the valve separates from the valve seat when a predetermined force is applied to the valve and the support and the urging device are formed as a one-piece member.

In exemplary embodiments, a valve device includes a valve that is movable; and a one-piece support. The one-piece support includes a valve seat with an opening exposing a bottom of the valve at an approximately central portion, wherein the valve seat is adjacent to the valve at an outer periphery of the opening, and an urging device that extends from the valve seat, the urging device directly contacting the valve and urging the valve toward the valve seat, wherein the valve separates from the valve seat when a predetermined force is applied to the valve.

In exemplary embodiments, an ink cartridge includes an ink chamber that can store ink; a communication chamber with a first opening that communicates with the ink chamber and a second opening that can receive an extract component; a valve that is positioned between the first opening and the second opening; and a support that supports a bottom surface of the valve and urges a top surface of the valve toward the second opening.

In exemplary embodiments, a method of supplying ink from an ink cartridge with a valve that is movable, a support that includes a valve seat and an opening exposing a bottom of the valve at an approximately central portion with the valve seat adjacent the valve at an outer periphery of the opening, and an urging device that extends from the valve seat with the urging device directly contacting the valve and urging the valve toward the valve seat, wherein the support and the urging device are formed as a one-piece member, includes moving an extract component into contact with the bottom of the valve; and applying a predetermined force to the valve such that the valve moves away from the valve seat and a top of the urging member flexes outwardly relative to a bottom of the urging member.

BRIEF DESCRIPTION OF THE DRAWINGS

Various exemplary embodiments of the invention will be described in detail with reference to the following figures, wherein:

FIGS. 6A, 6B and 6C are side views depicting rupture of a film member by an exemplary valve member according to the present invention, and FIGS. 6D, 6E and 6F are top views corresponding to FIGS. 6A, 6B and 6C, respectively;

FIG. 8A is a plan view, FIG. 8B is a side view, FIG. 8C is a sectional view taken along a line I-I line of FIG. 8A, FIG. 8D is a sectional view taken along a line II-II of FIG. 8A and FIG. 8E is a bottom view;

FIG. 9A is a plan view and FIG. 9B is a side view;

FIG. 11A depicts a state prior to installation and FIG. 11B depicts a state after installation;

FIG. 12A is a plan view, FIG. 12B is a sectional view and FIG. 12C is a bottom view;

DETAILED DESCRIPTION OF PREFERRED EMBODIMENTS

Figure 1:
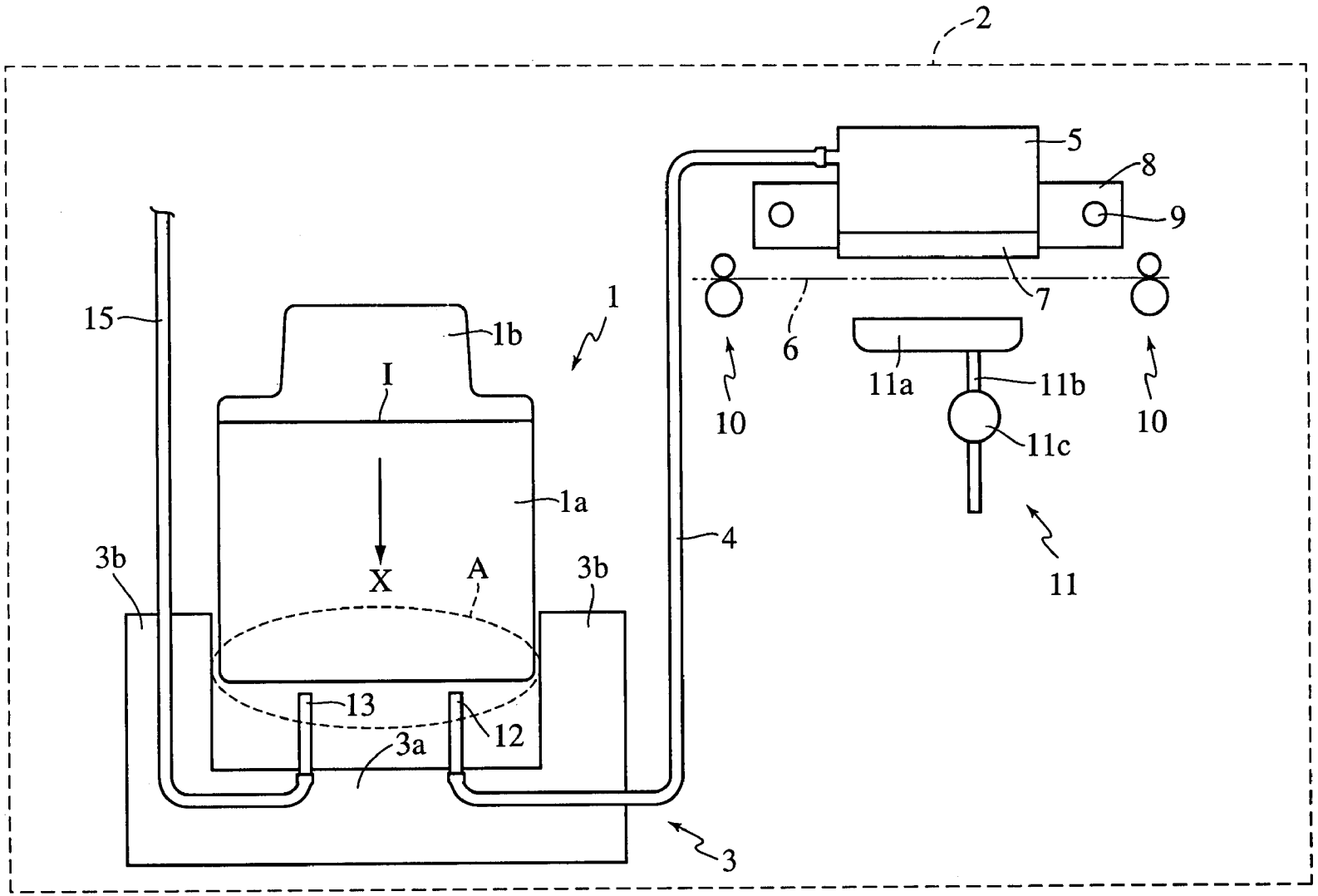
FIG. 1 is a schematic diagram of an exemplary ink cartridge according to the present invention and an exemplary inkjet recording apparatus according to the present invention on which the ink cartridge is mounted.

FIG. 1 is a schematic view showing an ink cartridge 1 according to an embodiment of this invention and an inkjet recording apparatus 2 to which the ink cartridge 1 mounts.

The ink cartridge 1 is formed so as to be detachable with respect to the inkjet recording apparatus 2 that is provided with a recording head 7 which ejects ink I. The ink cartridge 1 stores the ink I to be supplied to the recording head 7. One of a plurality of ink colors, such as cyan, magenta, yellow, black, or the like, is filled in the ink cartridge 1 as ink I, and a plurality of ink cartridges 1 that are filled with different ink colors are mounted to the inkjet recording apparatus 2. Color printing is thus made possible.

The inkjet recording apparatus 2 is provided with a mounting part 3 which detachably mounts the ink cartridge 1, a tank 5 which stores the ink I supplied from the ink cartridge 1 via an ink supply tube 4, the recording head 7 which emits the ink I stored in the tank 5 to recording paper 6, a carriage 8 in which the tank 5 and the recording head 7 are mounted and which is movable in two linear directions, a carriage shaft 9 which is a guide by which the carriage 8 moves in the two linear directions, a transport mechanism 10 which transports the recording paper 6, and a purge device 11.

The mounting part 3 is composed of a base part 3*a* that is sandwiched by a guide part 3*b* which is set on both sides of the base part 3*a*. A hollow ink extracting tube 12 extracts the ink I stored in the ink cartridge 1 and a hollow outside air intake tube 13 introduces outside air to the ink cartridge 1. The ink extracting tube 12 and the air intake tube 13 are examples of extract components.

The ink supply tube 4 is connected with one end side of the ink extracting tube 12, and the ink extracting tube 12 is connected to the tank 5 via the ink supply tube 4. The outside air intake tube 15 is connected to one end side of the air intake tube 13, and the outside air intake tube 13 is connected to outside air via the outside air intake tube 15.

The ink cartridge 1 is mounted from a direction (arrow X direction) perpendicular to the mounting part 3. At this time, the ink extracting tube 12 and the air intake tube 13 contact a valve member 32 (see FIG. 2) of the respective valve devices 18, 19 which is provided inside of the ink cartridge 1, push the respective valve members 32 up toward an ink chamber 16, and communicate with the inside of ink chamber 16.

A plurality of nozzle holes are provided in the recording head 7 on a surface to be opposite the recording paper 6. By driving an actuator composed of piezoelectric elements, the ink I stored in the tank 5 is emitted from the nozzle holes to the recording paper 6. Furthermore, if a recording operation is actually performed, recording is performed onto the recording paper 6 as the carriage 8, which mounts the recording head 7, moves back and forth.

Furthermore, the recording head 7 is arranged above the mounting part 3. A negative pressure (back pressure) is thus given to the ink I within the nozzle holes due to the pressure head difference between the ink cartridge 1 mounted in the mounting part 3 and the nozzle holes.

A purge device 11 is outside the recording area and arranged so as to face the recording head 7. The purge device 11 is provided with a purge cap 11*a* which covers a nozzle hole formation surface of the recording head 7, a waste ink tube 11*b* which communicates with the purge cap 11*a*, and a pump 11*c* which intakes ink from the nozzle holes via the waste ink tube 11*b*.

When the purge processing is performed, the carriage 8 is moved to a purge processing executing position, and the nozzle hole formation surface of the recording head 7 is covered by the purge cap 11*a*. In this state, by driving the pump 11*c*, poor ink that includes bubbles, dust or the like remaining inside the recording head 7 is vacuumed. The poor ink is then stored in an undepicted waste ink tank via the waste ink tube 11*b*. The recording operation and the purge process are controlled under a central processing unit (CPU) (not shown) mounted on the inkjet recording apparatus 2.

The ink cartridge 1 includes a container wall 1*a* in which the upper/lower end surfaces are open, and a lid 1*b* which is fixed in order to cover and seal the opening on the top surface of the container wall 1*a*. Furthermore, the container wall 1*a* and the lid 1*b* are formed of a resin material. The ink I to be supplied to the recording head 7 is stored in the ink chamber 16 formed inside the ink cartridge 1 (see FIG. 2).

Figure 2:
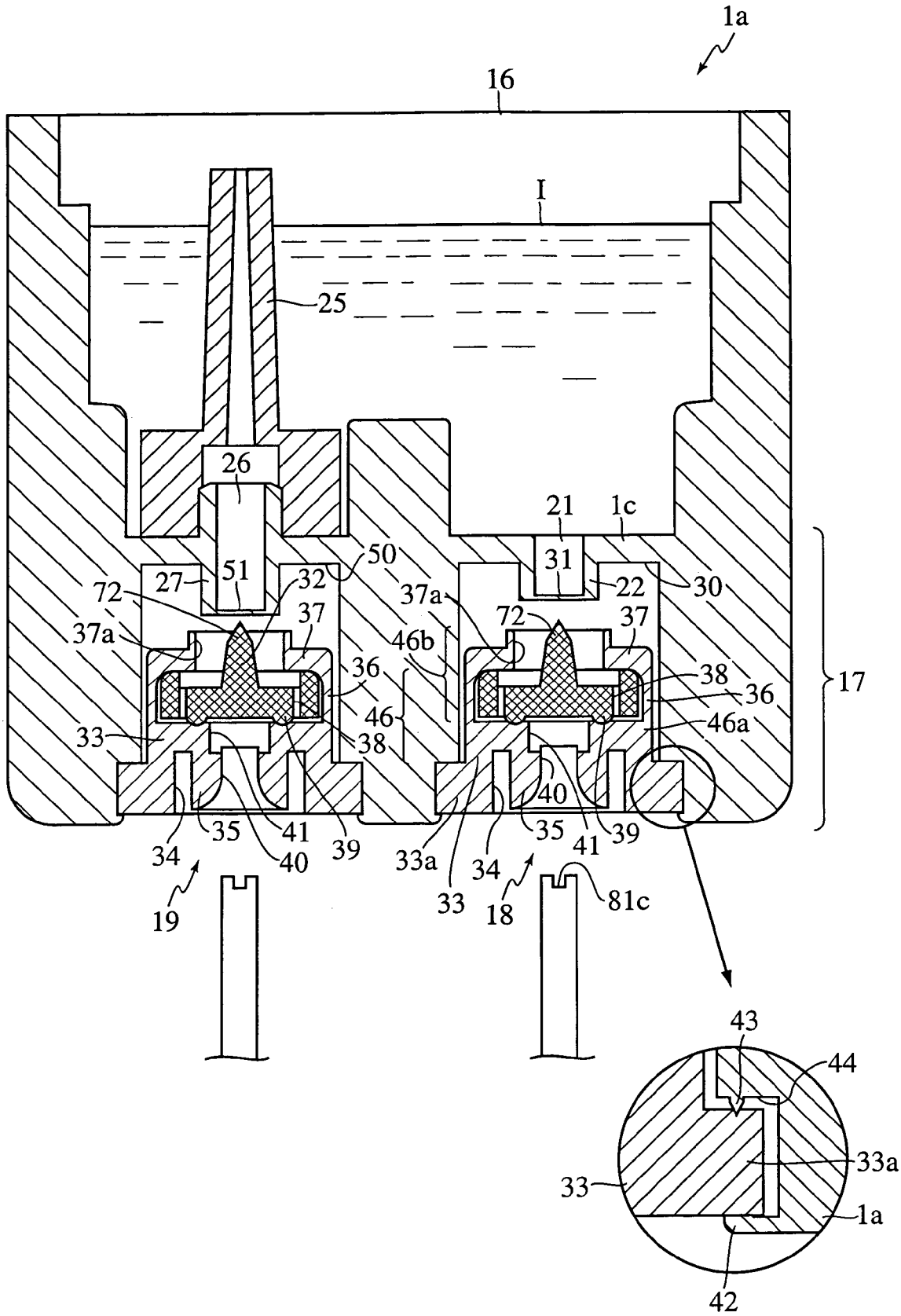
FIG. 2 is a sectional diagram showing the structure of an exemplary ink cartridge according to the present invention before the ink cartridge is loaded into an inkjet recording apparatus.
Figure 3:
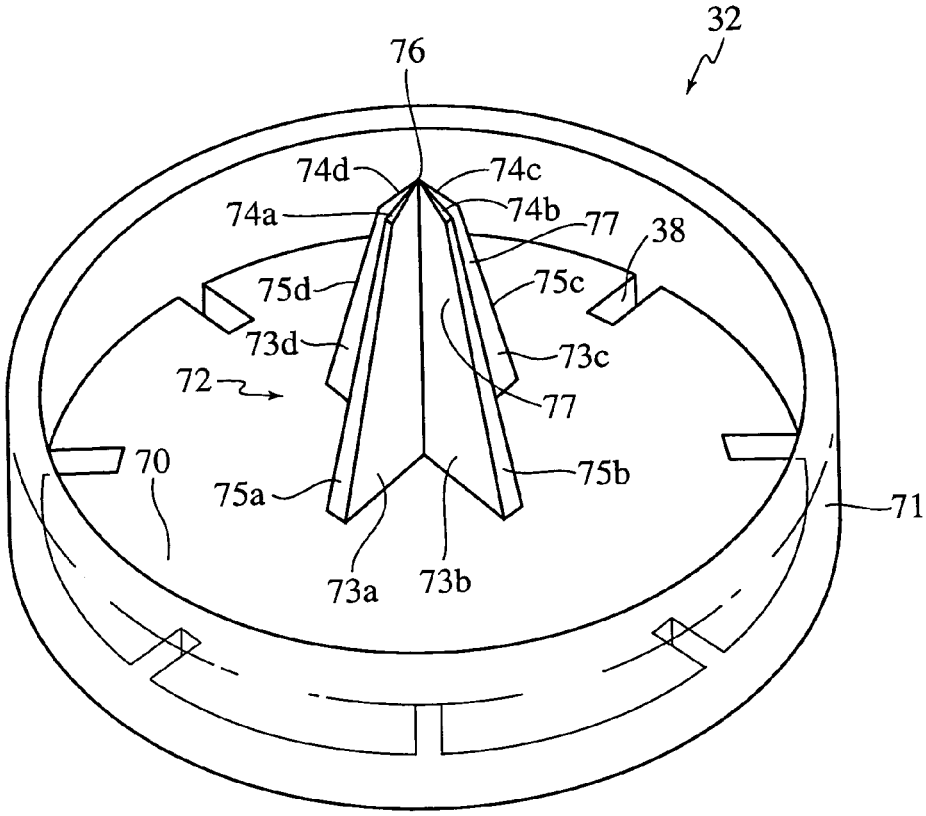
FIG. 3 is an oblique perspective view of an exemplary valve member according to the present invention.

Next, the structure of the ink cartridge 1, in particular part A of FIG. 1, which is installed in the inkjet recording apparatus 2 is explained with reference to FIGS. 2 and 3. FIG. 2 is a sectional diagram showing the structure of the ink cartridge before the ink cartridge is loaded into the inkjet recording apparatus and FIG. 3 is an oblique perspective view that illustrates the enlarged valve member.

As shown in FIG. 2, a partition wall 1*c* divides the inside of the ink cartridge 1 into two spaces and is formed integrally with the container wall 1*a*. Within these two spaces, the space between the partition wall 1*c* and the top opening covered by the lid 1*b* (i.e., the top half) is formed as the ink chamber 16 which stores ink, and the space between the partition wall 1*c* and the lower opening (i.e., the bottom half) is formed as a second chamber 17.

An ink supply port 21 for communicating with the ink chamber 16 and the second chamber 17 is formed in the partition wall 1*c*. A thin film member 31, which can be broken when the ink supply port 21 is closed, is formed of a resin material integrated with the container wall 1*a* at the lower end portion of a cylindrical wall 22 which extends from the partition wall 1*c* and surrounds the ink supply port 21. Furthermore, an air intake opening 26 for communicating with the ink chamber 16 and the second chamber 17 is formed in the partition wall 1*c*, and a thin film member 51 which can be broken when the air intake opening 26 is closed is formed of a resin material integrated to the container wall 1*a* at the lower end portion of a cylindrical wall 24 which depends from the partition wall 1*c* and surrounds the air intake opening 26. Thus, when the ink cartridge 1 is transported, the ink chamber 16 is sealed by the thin film members 31, 51, and it is possible to prevent the ink within the ink chamber 16 from leaking to the second chamber 17 via the ink supply port 21 and the air intake opening 26.

Furthermore, a barrel member 25 is arranged so as to protrude into the ink chamber 16 from the air intake opening 26. Outside air is introduced to the upper part of the ink chamber 16 via the air intake opening 26 and the barrel member 25.

On the partition wall 1*c*, a barrel-shaped body 30 as an example of a communication chamber, which extends toward the opening of the second chamber 17, is connected and formed so as to protrude into the second chamber 17 from the partition wall 1*c* and surround the cylindrical wall 22. In addition, on the partition wall 1*c*, a second barrel-shaped body 50 as an example of a communication chamber, which extends toward the opening of the second chamber 17, is connected and formed so as to protrude into the second chamber 17 from the partition wall 1*c* and surround the cylindrical wall 24.

To make the space between a later-described pointed part 72 and the film member 51 smaller than the space between the pointed part 72 and the film member 31, the cylindrical walls 22 and 24 are formed such that the amount that the cylindrical wall 24 extends from the partition wall 1*c* is larger than the amount that the cylindrical wall 22 extends from the partition wall 1*c*.

The valve device 18 is fixed inside the barrel-shaped body 30 and the valve device 19 is fixed inside the second barrel-shaped body 50. The valve devices 18, 19 can selectively communicate between the inside and the outside of the ink chamber 16 and cut off communication between the inside and the outside of the ink chamber 16.

Here, the valve device 18 is explained. The valve device 19, which is fixed to the second barrel-shaped body 50, has the same shape as the valve device 18. As such, only a detailed explanation of the valve device 18 will be provided.

The valve device 18 is provided with a support member 46 which is integrally manufactured by a rubber elastic member and the valve member 32 composed of a resin material. The support member 46 has a substantially cylindrical shape and is integrally molded and includes a valve seat part 46*a* in the intermediate part in the axial direction, an urging part 46*b* that is closer to the ink chamber 16 than the valve seat part 46*a*, a cylindrical part 35 which extends from the valve seat part 46*a* toward a side opposite the urging part 46*b*, and an outer circumferential wall 33 which extends parallel to, and is spaced from, the outer circumference of the cylindrical part 35. In other words, the valve seat part 46*a* and the urging part 46*b* are integrally formed as a one-piece member. The valve member 32 is housed within the urging part 46*b*, and is urged by the urging part 46*b* toward the valve seat part 46*a*.

The valve device 18 has a positioning part 33*a* which protrudes from the outer circumferential wall 33 to an outer circumferential external direction towards the barrel-shaped body 30. The barrel-shaped body 30 is formed so that a part of the barrel-shaped body 30 has a smaller external diameter than that of the positioning part 33*a*. A step-shape is thus formed in the barrel-shaped body 30 that contacts the positioning part 33*a*.

As shown in the enlarged diagram in FIG. 2 in which the fixed parts of the valve device 18 and the barrel-shaped body 30 are enlarged, the barrel-shaped body 30 has a surface 44 with the diameter becoming larger in tiers outwardly in order to contain the positioning part 33*a*. A projection 43 is formed on the surface 44 and is above the positioning part 33*a*. A holding wall 42 is also provided and projects inwardly around the opening of the barrel-shaped body 30 of the container wall la. When the valve device 18 is inserted into the barrel-shaped body 30, the holding wall 42 holds and presses the positioning part 33*a* into the projection 43 while being deformed and bent by heat. The combination of the holding wall 42 and the projection 43 thus fixes and seals the valve device 18 relative to the barrel-shaped body 30. By doing so, ink is prevented from flowing out from the space formed between the external wall of the valve device 18 and the inner wall of the barrel-shaped body 30.

The valve seat part 46*a* has an opening 41 which goes through the center in the axial direction. When the ink cartridge 1 is mounted to the inkjet recording apparatus 2, the cylindrical part 35 seals the ink extracting tube 25 inserted therein. The cylindrical part 35 is provided with an introducing path 40 in which the ink extracting tube 12, which is protruding from the inkjet recording apparatus 2, is inserted. The cylindrical part 35, as an example of an inner peripheral wall, is integrally connected with the valve seat part 46*a* in a state in which the introducing path 40 is connected to the opening 41. The valve member 32 contacting the valve seat part 46*a* is exposed to the outside through the opening 41 and the introducing path 40, and faces the ink extracting tube 12 inserted therein. The introducing path 40 is formed smaller than the outer diameter of the ink extracting tube 12 so as to closely fit to the inserted ink extracting tube 12. The opening 41 is formed larger than the outer diameter of the ink extracting tube 12. An end of the introducing path 40, from which the ink extracting tube 12 is inserted, is formed in a tapered shape in which the diameter increases towards the outside.

The cylindrical part 35 and the outer circumferential wall 33, as an example of an outer peripheral wall, are separated by a predetermined distance by a ring-shaped groove 34. The cylindrical part 35 is made elastically deformable in a plane perpendicular to the direction of the center axis of the introducing path 40 with respect to the outer circumferential wall 33. As a result, it is easy to expand the cylindrical part 35 in accordance (in the Y direction in FIG. 5) with the insertion of the ink extracting tube 12 into the introducing path 40, such that the fit between the introducing path 40 and the ink extracting tube 12 is improved. Leakage of the ink is thereby prevented. In addition, even if the ink extracting tube 12 is inserted diagonally or offset to the introducing path 40, the ink extracting tube 12 can be inserted to the introducing path 40 due to the deformation of the cylindrical part 35. Furthermore, in accordance with the insertion of the ink extracting tube 12 to the introducing path 40, the inner wall part of the introducing path 40 is slightly pushed toward the valve member 32 and thus elastically deforms. However, such deformation is absorbed in the space in the opening 41 having a large diameter, and thus, the valve member 32 is not pushed.

Furthermore, the cylindrical part 35 is formed with a length that cannot reach the lower edge of the outer circumferential wall 33. In other words, the edge of the ink extract tube 12 is inserted. Thus, the remaining ink in the cylindrical part 35 does not soil the surface of a flat surface when the valve device 18 is placed on that flat surface.

The urging part 46*b* is formed by a side wall part 36 which stands out in a cylindrical shape on the ink chamber 16 side from the outer circumference of the valve seat part 46*a* and a projection part 37 which extends from the side wall part 36 and extends inward so as to contact the ink chamber 16 side of the valve member 32. The urging part 46*b* is also provided with an opening 37*a* in the center of the projection part 37. The urging part 46*b* urges the valve member 32 based on the elasticity of the side wall part 36 and the projection part 37. In a normal state before the ink cartridge 1 is mounted to the inkjet recording apparatus 2, the valve member 32 contacts the valve seat part 46*a*. When the ink cartridge 1 is mounted to the ink jet recording apparatus 2, the ink extracting tube 12 enters the introducing path 40 and pushes the valve member 32 up toward the ink chamber 16 so that the side wall part 36 is extended, the projection part 37 is inclined, and a gap for an ink flow path is formed between the valve member 32 and the valve seat part 46*a*.

The radial thickness t1 (see FIG. 5A) of the side wall part 36 (perpendicular to the axial direction mentioned above) is formed thinner than the thickness t2 (see FIG. 5A) of the valve seat part 46*a* in the intruding direction of the ink extracting tube 12 to the introducing path 40 and the radial thickness of the outer circumferential wall 33. For this reason, if the valve member 32 is pushed up by the ink extracting tube 12, the urging part 46*b* allows for a larger elastic deformation as compared to the valve seat part 46*a* and the outer circumferential wall 33, which forms a clearance between the valve member 32 and the valve seat part 46*a*.

The valve member 32 in FIG. 3 is explained next. The valve member 32 is provided with a bottom part 70 which contacts the valve seat part 46*a* of the support member 46, a valve side wall part 71 which extends in a cylindrical shape toward the ink chamber 16 from the outer circumference of the bottom part 70, and a pointed part 72, which projects toward the ink chamber 16 in the substantially center part of the bottom part 70, and on which the tip end on the ink chamber 16 side is formed in a pointed shape (e.g., an acuminate shape). The pointed part 72 projects closer to the ink chamber 16 than the valve side wall part 71 extends.

The bottom part 70 has a projecting component 39 (see FIG. 2) which projects toward the valve seat part 46*a* and is formed circularly on a surface edge set up against the valve seat part 46*a*. The projecting component 39 is also located inside the valve side wall part 71 and outside the introducing path 40. While the valve member 32 is contained in the support member 46, the valve side wall part 71 closely contacts the lower surface of the projection part 37 of the urging part 46*b* and is pressed. Due to such pressing, the projecting component 39 deforms the valve seat part 46*a* elastically and closely contacts the upper surface of the valve seat part 46*a*.

In the bottom part 70, circumferentially inward with respect to the valve side wall part 71 and circumferentially outward with respect to the opening 41, a plurality of communication paths 38 are formed which communicate with the ink chamber 16 side of the valve member 32 and the valve seat part of the valve member 32. In this example, eight communication paths 38 are formed, however, the number is not specifically limited and any number can be formed.

The pointed part 72 consists of four plate components 73*a*-73*d* which are positioned in the approximate center of the bottom part 70 and are combined in the form of an approximate cross. The plate components 73*a*-73*d* form grooves 77 extending in parallel and along the axial line between the plate components 73*a*-73*d* located next to each other. Each of the plate components 73*a*-73*d* are, in the direction to the bottom part 70 from the tip 76, equipped with first slope units 74*a*-74*d* which slope at a first angle (for example, approximately "45 degrees" in this example) against the central axial line extending in the same direction and second slope units 75*a*-75*d*, next to the first slope units 74*a*-74*d*, which have a second angle (for example, approximately "10 degrees" in this example), which is more acute compared to the first angle, in the direction to the bottom part 70 from the first slope units 74*a*-74*d*.

The pointed part 72 projects through the opening 37*a* of the projection part 37 and is positioned opposite the film member 31 with the tip 76 spaced at an interval from the film member 31. When the ink cartridge 1 is mounted to the inkjet recording apparatus 2, as the ink extracting tube 12 pushes up the bottom part 70 of the valve member 32, the thin film member 31 breaks, and an ink flow path is formed which goes through the ink supply port 21, the opening 37*a*, the communication paths 38, and the ink extracting tube 12.

When the ink cartridge 1 is detached from the inkjet recording apparatus 2, the bottom part 70 and the valve seat part 46*a* are connected by an urging force of the urging part 46*b*, and the ink flow path is cut off.

Furthermore, when the ink cartridge 1 is mounted to the inkjet recording apparatus 2, an air intake tube 13, which is arranged by being protruded from the inkjet recording apparatus 2, is inserted into the valve device 19. In the same manner as the above-mentioned ink supply, an outside air flow path is formed which goes through the air intake opening 26, the opening 37*a*, the communication paths 38, and the air intake tube 13. At approximately the same time, when the ink cartridge 1 is detached from the inkjet recording apparatus 2, an outside air flow path is cut off by the urging force of the urging part 46*b*.

Figure 4:
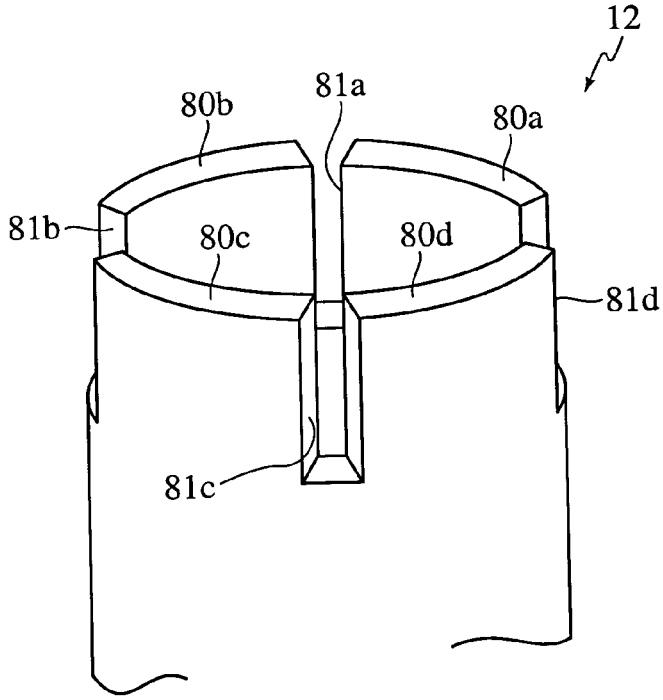
FIG. 4 is an oblique perspective view of a tip part of an exemplary ink extract tube according to the present invention.

Next, the ink extract tube 12 and the air intake tube 13 are explained by referring to FIG. 4. FIG. 4 is an oblique perspective figure that illustrates the configuration of the neighboring area of the tip part on the side of the ink extract tube 12. Furthermore, the ink extract tube 12 and the air intake tube 13 are structured in the same configuration and dimensions, and therefore, the explanations are made about the ink extract tube 12 and the explanations about the air intake tube 13 are omitted.

The edge of the tip of the ink extract tube 12 on the side of the valve member 32 is open, and a contact section with the valve member 32 consists of end sections 80*a*-80*d* formed on the approximate plane. And the communicating passages 81*a*-81*d* are formed in the shape of grooves cut on the external wall of the ink extract tube 12. These communicating passages 81*a*-81*d* are formed at approximately even intervals on the external wall of the ink extract tube 12. Note that in this example, four communicating passages 81*a*-81*d* are formed however, any number can be formed.

The ink extract tube 12 has the end sections 80*a*-80*d* formed on the approximate plane, and can press the contact surface of the valve member 32 approximately evenly when it contacts with the valve member 32. Therefore, tilting of the valve member 32 is avoided and the valve member 32 can constantly maintain the ink passage at a certain level. The communicating passages 81*a*-81*d* are cut and are formed such that even if the ink extract tube 12 is in contact with the valve member 32, the passage of the ink through the communicating passages 81*a*-81*d* can be reliably obtained.

Furthermore, since the tip of the ink extract tube 12 is formed on the approximate plane, even if the ink extract tube 12 is installed in a projected state from the installation unit 3, the user will not be hurt by touching the ink extract tube 12 because the tip is no longer formed in an acuminate shape as before.

The valve device 19, positioned in the second barrel-shaped body 50 on the side of the air intake, uses exactly the same components as the valve device 18 on the side of ink supply mentioned above, fixed in a similar way. Each part of the air intake tube 12 is in a similar dimensional relationship to that of the air intake tube 13, and therefore, detailed explanations are omitted.

Figure 5A:
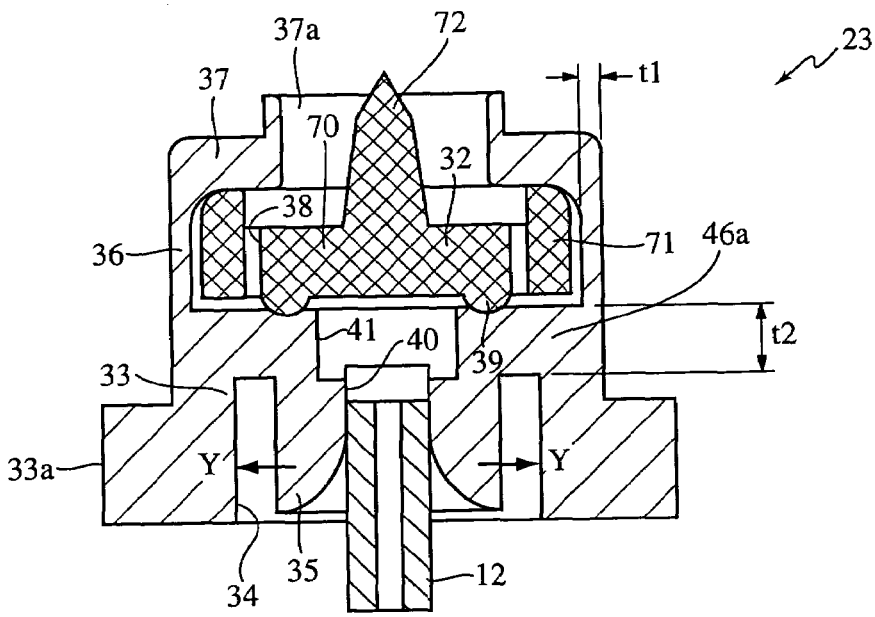
FIG. 5A is a sectional view of an exemplary ink extract tube according to the present invention before the ink extract tube enters into a guide path and contacts an exemplary valve member according to the present invention.
Figure 5B:
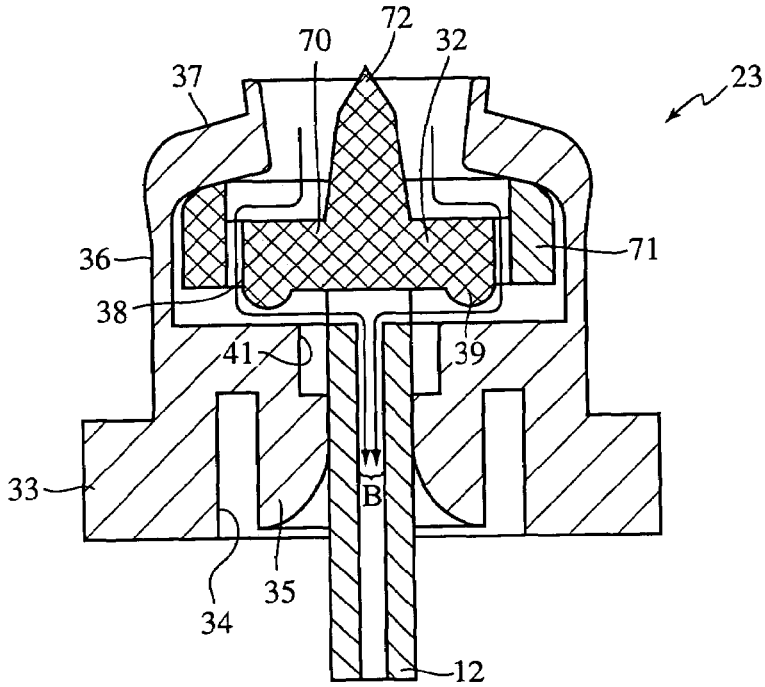
FIG. 5B is a cross-section view of an exemplary ink extract tube according to the present invention contacting an exemplary valve member according to the present invention and pushing the valve member toward an ink chamber.

Here, the motion of the valve device 18, when the ink cartridge 1 is loaded into the inkjet recording apparatus 2, is explained by referring to FIGS. 5A and 5B. When the ink cartridge 1 is loaded into the mounting part 3, the ink extract tube 12 intrudes into the introducing path 40 (FIG. 5A), and closely contacts the inside of the introducing path 40 in a state that blocks the outflow of the ink. When the ink extract tube 12 and the valve member 32 contact each other and the valve member 32 is pushed towards the ink chamber 16 (FIG. 5B), the valve member 32 is separated from the valve seat part 46*a* by resisting the elasticity of the urging part 46*b*. In addition, when the valve member 32 is pushed up, the tip 76 of the pointed part 72 contacts the film member 31 and ruptures the film member 31. As a result, the ink in the ink chamber 16 is supplied to the barrel-shaped body 30, when the ink enters into the opening 37*a* at the top end of the valve device 18, passes through the communication paths 38 of the valve member 32, between the lower surface of the valve member 32 and the upper surface of the valve seat part 46*a*, into the communicating passages 81*a*-81*d* of the ink extract tube 12 (the ink passage B), and is supplied to the recording head 7. As for the motion of the pointed part 72 to rupture the film member 31, further explanations are given below.

At approximately the same time when the ink extract tube 12 mentioned above intrudes, the air intake tube 13 enters into the valve device 19 on the side of second barrel-shaped body 50 and pushes up the valve member 32. Since the space between the film member 51 and the tip 76 of the pointed part 72 is smaller than the space between the film member 31 and the tip 76 of the pointed part 72, the thin film 51 is ruptured first as compared to the film member 31 on the side of the ink extract tube 12. In general, the ink cartridge 1 is packed in a decompressed state in order to keep the ink in the ink cartridge 1 in a deaerated state and the ink chamber 16 under a reduced pressure as well. As mentioned above, by rupturing the film member 51 on the side of the air intake tube 13 quickly, the film member 31 on the side of the ink extract tube 12 is ruptured after the air is led to the upper part of the ink chamber 16 through the barrel member 25. The supply of the ink to the ink extract tube 12 is thus ensured. If the film member 31 on the side of the ink extract tube 12 is ruptured too early, the air enters into the ink passage of the ink extract tube 12 which prevents a smooth supply of the ink.

When the ink cartridge 1 is pulled up from the installation unit 3 in order to remove the loaded ink cartridge 1 from the inkjet recording apparatus 2, the ink extract tube 12 and the air intake tube 13 are separated from each of the corresponding valve members 32. At the same time, each valve member 32 returns to a state of closely contacting with the valve seat part 46*a* due to the biasing operation of the urging part 46*b*. At this point, since the circular projecting component 39 is installed on the surface set up against the valve seat part 46*a*, the ink chamber 16 is reliably sealed in order to prevent ink from leaking. In addition, the ink I remaining near the opening 41 of the valve seat part 46*a* on the side of the ink extract tube 12 is maintained at that position forming a meniscus and does not leak outside since the atmospheric pressure does not apply to the ink on the upper side because the upper part is blocked by the valve member 32 and the diameter of the introducing path 40 is small (approximately 2 mm in diameter).

Next, FIGS. 6A-6F show how the film member 31 is ruptured by the pointed part 72. The film member 51 is ruptured in the same manner as the film member 31, and therefore, such explanations are omitted.

FIG. 6A shows the state where the pointed part 72 is pushed up together with the valve member 32 towards the ink chamber 16 and the tip 76 closely contacts with the film member 31. In this state, the film member 31 is not ruptured yet (the state of FIG. 6D).

FIG. 6B shows the state where the pointed part 72 is pushed up further and the film member 31 is ruptured by the first slope units 74*a*-74*d*. The film member 31 thus only contacts the first slope units 74*a*-74*d* of the pointed part 72. Since the film member 31 contacts the first slope units 74*a*-74*d* along the upper surface thereof, the groove 77 is blocked in this state and the passage of the ink is hardly formed (see FIG. 6E).

FIG. 6C shows the ink cartridge 1 completely loaded into the inkjet recording apparatus 2, and the film member 31 is pushed and widened by the second slope units 75*a*-75*d* of the pointed part 72. Because of this, as shown in FIG. 6F, the groove 77 between each plate component 73*a*-73*d* is released and the ink passage C connecting the ink chamber 16 and the ink extract tube 12 is formed. The ink passage C is also formed at approximately even intervals around the circumference of the pointed part 72. It is thus possible to supply the ink to the ink extract tube 12 almost evenly.

When the film member 31 is pushed and widened by the second slope units 75*a*-75*d* instead of the first slope units 74*a*-74*d*, the curving angle of the ruptured part of the film member 31 changes and the ruptured part is separated from the groove 77 between the plate components 73*a*-73*d*, and the ink passage is formed as mentioned above. Furthermore, since the amount of contact between the film member 31 and the plate components 73*a*-73*d* becomes lower, when the ink cartridge 1 is removed, the pointed part 72 and the film member 31 are reliably separated by the biasing of the urging part 46*b*.

As explained above, based on the ink cartridge mentioned above, the valve member 32 which has a pointed part 72 with the tip formed in an acuminate shape to rupture the film member 31 is retained by the support member 46, and such support member 46 is fixed in the barrel-shaped body 30. Because of this, when the ink cartridge 1 is loaded into the inkjet recording apparatus 2, the valve member 32 is pushed up towards the ink chamber 16 by the ink extract tube 12. At the same time, the film member 31 is ruptured and the ink passages B and C, which connect the ink chamber 16 and the ink extract tube 12, are formed. Therefore, it is not necessary to form the tip of the ink extract tube 12 in an acuminate shape, which can prevent the user from being hurt by the ink extract tube 12 and thus, can further improve the safety.

Furthermore, since it is not necessary to form the tip of the ink extract tube 12 in an acuminate shape, it is also not necessary to newly position a preventative device that covers the ink extract tube 12. It is thus possible to prevent the inkjet recording apparatus from becoming large-scaled and at the same time, since the number of components does not increase, an increase in production cost can be prevented.

This invention has been explained based on the examples as mentioned above. However, this invention is not limited to the examples explained above and it can be easily assumed that various improvements and modifications are possible.

For example, in the above examples, the outside dimensions of the valve devices 18 and 19 are set a little smaller than the inside dimensions of the barrel-shaped bodies 30 and 50, and they are fixed by being pressed by the holding wall 42. However, it is acceptable to make the outside dimensions of the valve devices 18 and 19 a little bigger than the inside dimensions of the barrel-shaped bodies 30 and 50 and fix them by pushing the valve devices 18 and 19 into the barrel-shaped bodies 30, 50.

And also, in the examples mentioned above, the communicating passages 81*a*-81*d* are formed by cutting the ink extract tube 12 and the air intake tube 13 including the tip on the side of the ink chamber 16. However, it is acceptable to form the communicating passages 81*a*-81*d* communicating with the inside and the outside on the side wall of the ink extract tube 12 and the air intake tube 13.

Furthermore, in the examples mentioned above, the valve member 32 is formed as a unit with the pointed part 72 with the tip formed in an acuminate shape, the bottom part 70 and the valve side wall part 71. However, it is acceptable to form the breaking unit to rupture the film component and the valve which communicate and block off the ink chamber 16 side and the outer side of the container wall 1*a* separately.

Figure 7:
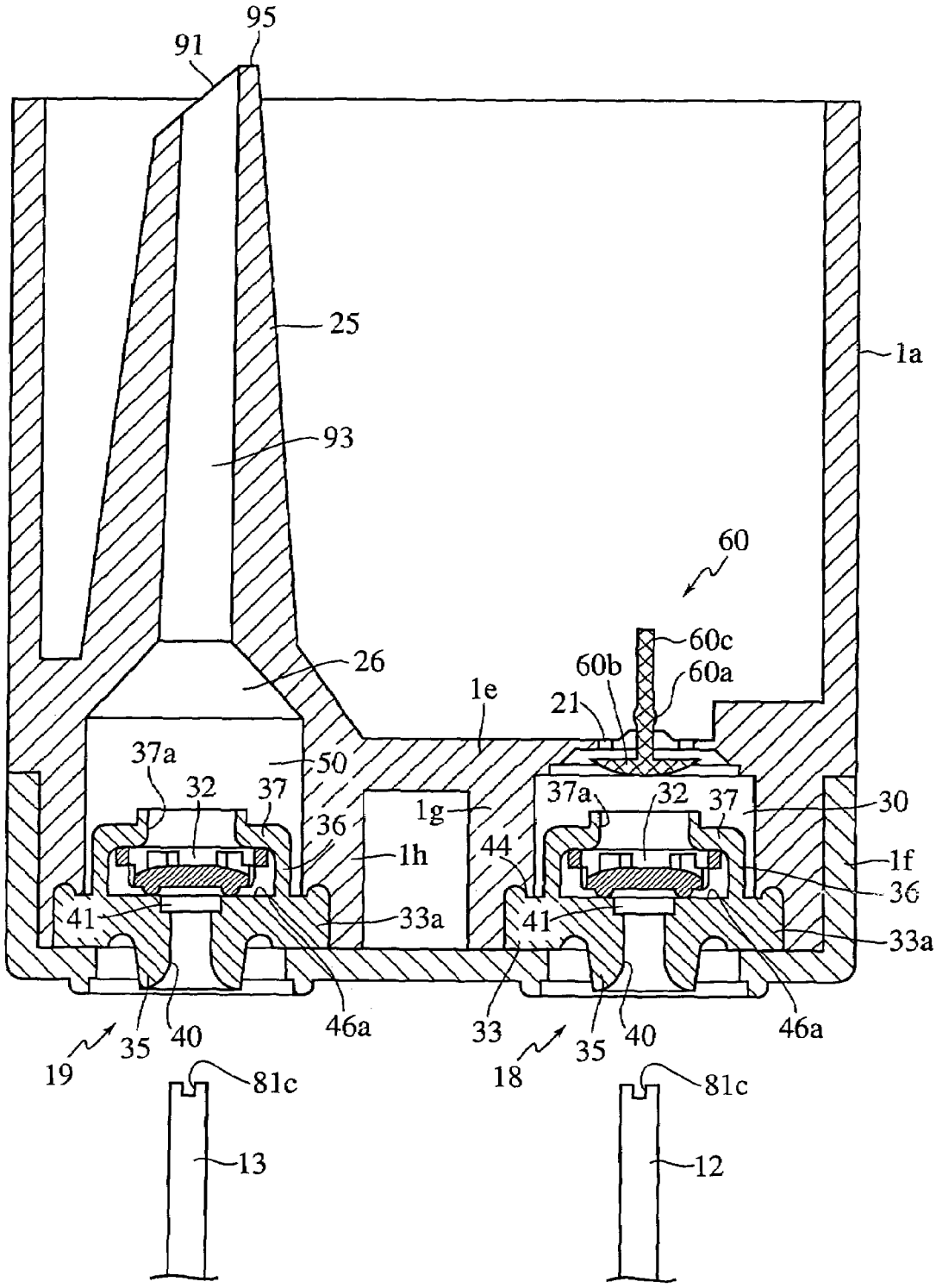
FIG. 7 is a sectional diagram showing the structure of an exemplary ink cartridge according to the present invention before the ink cartridge is loaded into an inkjet recording apparatus.

FIG. 7 illustrates an ink cartridge according to a second embodiment of the invention. It is noted that elements similar to or identical with those in the first embodiment are designated by similar numerals, and thus the description thereof can be omitted for the sake of brevity.

The ink cartridge 1 of the second embodiment includes the ink chamber 16 with an open top, the container wall 1*a*, and a cover 1*f* that covers the floor area 1*e*. The ink cartridge 1 also includes two walls 1*g* and 1*h* that form the barrel-shaped bodies 30 and 50 which are open downward. The valve device 18 is placed in the barrel-shaped body 30 and the valve device 19 is placed in the barrel-shaped body 50. The valve device 18 and the valve device 19 are identical and when they are attached to the inkjet recording device, the ink extracting tube 12 is inserted into the barrel-shaped body 30 and the air intake tube 13 is inserted into the barrel-shaped body 50.

Similar to the first embodiment, the valve device 18 and 19 have the support member 46 made of rubber-like flexible part material and the valve member 32 is made of resin. The support member 46 has basically the same structure as the support member 46 of the first embodiment, but the outer circumferential wall 33 does not extend as far as the cylindrical part 35 in the first embodiment. The outer circumferential wall 33 and positioning part 33*a* are both formed almost at the same level as the valve seat part 46*a*. The positioning part 33*a* is fixed at the lower end of cylinder shape walls 1*g* and 1*h*, between the surface 44 that is formed as a part of the barrel-shaped bodies 30 and 50 and cover 1*f*. With this arrangement, the valve devices 18 and 19 are fixed on the container wall 1*a*.

FIGS. 8A-8E show the details of the valve member 32. The valve member 32 consists of the bottom part 70 and the valve side wall part 71 which extends vertically from the external circumference of the bottom part 70. The communication paths 38 are formed in the external circumference of the bottom part 70 and in the valve side wall part 71 contiguously at a plurality of positions. At one side of each of the communication paths 38, a protruding part 59 with a substantially rectangular shape rises at a right angle out of the bottom part 70 with one side of the protruding part 59 touching the valve side wall part 71. If the opening part of the communications paths 38 has a round shape, the round shape prevents smooth ink flow because the round shape tends to form a meniscus due to the surface tension of the ink. In order to avoid the formation of meniscus, the opening part may not have a round shape. Another effective method is to use multiple surfaces for the opening areas.

Figure 8A:
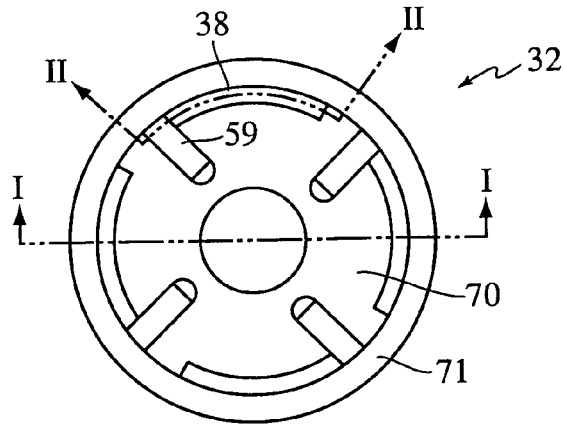
FIGS. 8A-8E depict an exemplary valve member according to the present invention.
Figure 8B:
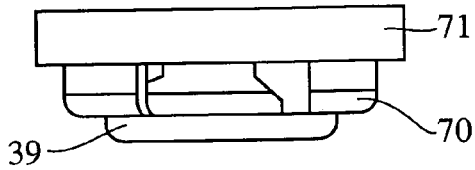
Figure 8C:
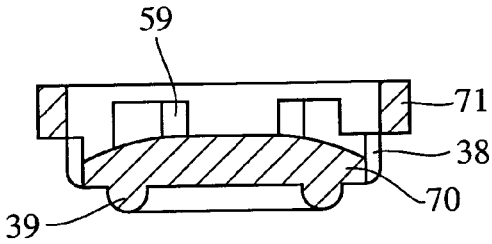
Figure 8D:
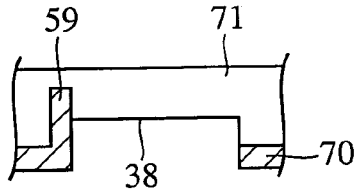
Figure 8E:
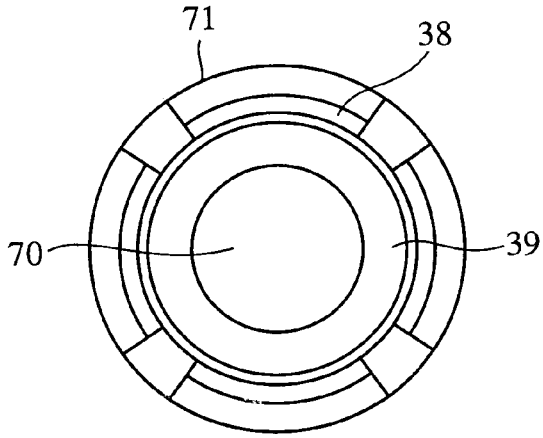

The ridge line of the communication paths 38 as shown in FIG. 8C is formed in an arc shape and also covers two surfaces that cross at a right angle with the bottom part 70 and the valve side wall part 71.

Moreover, the rectangular projection part 59 is formed along one of the ridge lines of the communication paths 38, rising vertically out of the opening part of the linked communication paths 38. Therefore the opening part of the communication paths 38 consists of the surface formed of the protruding part 59, the surface formed by the bottom part 70, and the surface formed by the valve side wall part 71. With this structure, the opening part becomes complex and thus prevents the formation of a meniscus. Where the bottom part 70 touches the valve seat part 46*a*, the projecting component 39 is formed in a ring-shape at an area closer to the center of the bottom part 70 than the communication paths 38 but external to the opening 41. When the valve member 32 is closed, the valve member 32 presses against the valve seat part 46*a*.

In the second embodiment, the air intake opening 26 includes a tapered portion above the barrel-shaped body 50. A barrel member 25 extends from the tapered portion at the floor 1*e* toward an upper end of the cartridge 1. The barrel member 25 includes an opening 91 at an upper end. When the cartridge 1 is filled with ink and situated in an upright alignment, the opening 91 is positioned above the ink surface level in the ink chamber 16. In various exemplary embodiments, an upper face 95 of the barrel member 25, including the opening 91, is inclined or slanted with respect to horizontal. In some such embodiments, the upper face 95 has a stepped configuration, such that the upper face 95 includes multiple surfaces, the surfaces defining at least two different planes. As a result of the slant or inclination of the upper face 95 of the barrel member 25, a cross sectional area of the opening 91 of the barrel member 25 taken at the slanted or inclined upper face 95 is greater than a horizontal cross sectional area of an interior portion 93 of the barrel member 25. In addition, a horizontal diameter of the interior portion 93 of the barrel member 25 is preferably at least about 0.8 mm.

The slanted, inclined or stepped configuration of the opening 91 of the barrel member 25, as well as the diameter of the interior portion 93 of the barrel member 25, prevent an ink meniscus from forming in the event that ink from the ink chamber 16 contacts the opening 91, if, for example, the cartridge 1 is positioned other than in an upright alignment. It is advantageous to prevent formation of such an ink meniscus in the opening 91, because, if an ink meniscus is formed, the process of supplying ink during operation of the image recording apparatus 2 will cause the meniscus to repeatedly break and reform. This breaking and reforming of the meniscus results in a repeating variation of an internal pressure of the cartridge 1. Such variation can adversely affect print quality.

In various exemplary embodiments, the barrel member 25 is formed integrally with the remainder of the ink chamber 16. Such an integral structure obviates the necessity for multiple manufacturing steps to form and join the ink chamber 16 and the barrel member 25. Accordingly, the time and cost necessary to manufacture cartridges, such as disclosed herein, are reduced.

The ink supply port 21 at the ink supply side has the anti-counter flow valve 60. The anti-counter flow valve 60 consists of an umbrella shaped flexible membrane part 60*b* that faces the lower surface of the ink supply port 21 and a spindle part 60*c* that supports one end of the membrane part 60*b*. Both the membrane part 60*b* and the spindle part 60*c* are formed into one shape using synthesized resin material. The spindle part 60*c* is inserted through the ink supply port 21 so that the flow valve 60 can slide up and down. Normally, the membrane part 60*b* is positioned at a distance from the ink supply port 21, and an extended part 60*a* touches the top surface of the floor wall 1*e*. Ink is thus allowed to smoothly flow from the ink chamber 16 toward the valve device 18. When ink starts to flow from the ink extraction tube 12 toward the ink chamber 16, the membrane 60*b* will rise and block the ink supply port 21 and thus stop the flow of ink.

As described earlier, the ink chamber 16 is packaged at reduced pressure. As such, when the ink cartridge 1 is attached to the inkjet recording device 2, if the valve device 18 is opened before the valve device 19, it is possible that ink already present in the ink extract tube 12 will flow from the ink extract tube 12 toward the ink chamber 16. Such flow of ink toward the ink chamber 16 will also draw ink present in the recording head 7, to which the ink extract tube 12 is connected, toward the ink chamber 16. Drawing ink present in the recording head 7 toward the ink chamber 16 can disrupt ink meniscuses present in nozzle holes of the recording head 7. Disruption of the meniscuses can adversely affect print quality. If the valve device 18 is opened before the valve device 19 when air is present in the ink extract tube 12, such air may flow from the ink extract tube 12 toward, and possibly into, the ink chamber 16. Such flow of air into the ink chamber 16 will adversely affect the deaerated state of the ink present therein possibly reducing print quality. To prevent such backflow of air or ink, the anti-counter flow valve 60 is used.

At the time of attachment, when the ink cartridge 1 is mounted on the mounting part 3, the ink extracting tube 12 is inserted into the introducing path 40 and pushes the valve member 32 upward. The valve member 32 in turn pushes the projection part 37 of the urging part 46*b* upward, and subsequently the side wall part 36 extends and the valve member 32 detaches from the valve seat part 46*a*. As a result, the ink in the ink chamber 16 is supplied to the ink extracting tube 12 through the communication paths 38 of the valve member 32 and the communicating passages 81*a*-81*d* of the ink extract tube 12. At the same time, the air intake tube 13 is connected with barrel-shaped body 50, letting the outside air flow into the ink chamber.

Unlike the first embodiment, film members 31, 51 are not used and accordingly a pointed part 72 is not used to rupture the film members 31, 51. As such, when the valve member 32 is pushed up, ink exists in the barrel shaped bodies 30, 50. However, since the circular projecting component 39 is urged against the valve seat part 46*a* by the projection part 37, the ink chamber 16 and the top of the barrel shaped bodies 30, 50 are reliably sealed in order to prevent ink from leaking.

Figure 9A:
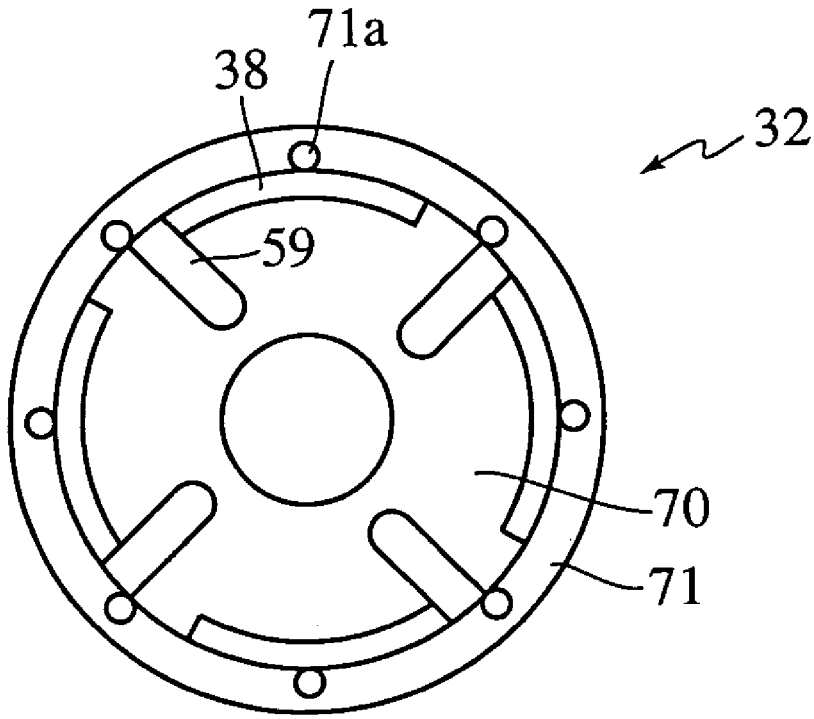
FIGS. 9A and 9B depict an exemplary valve member according to the present invention.
Figure 9B:
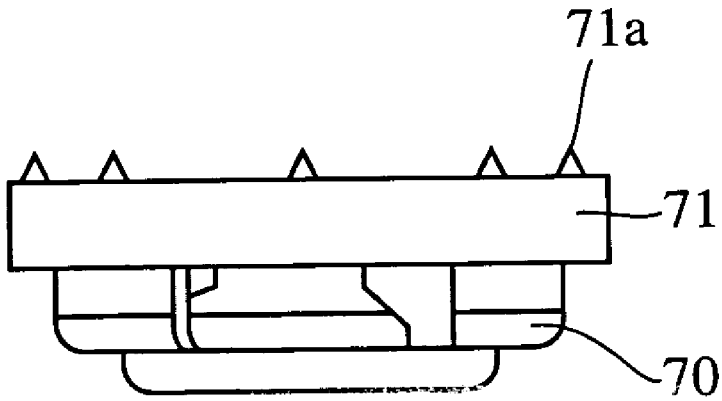

FIGS. 9A and 9B show a variation of the valve member 32 shown in FIG. 8. As noted above, when the ink cartridge 1 is installed on the mounting part 3, the ink extracting tube 12 and air intake tube 13 push the valve member 32 upward, and the valve member 32 in turn pushes the projection part 37 of the urging part 46*b* installed in the support member 46.

On the other hand, because there are disparities in the length of the ink extracting tube 12 and the air intake tube 13, and there are also disparities in distance from the bottom of the ink cartridge 1 to the valve member 32 depending on many other parts. The overall disparity can thus become relatively large. When the disparity is large, and when the ink cartridge 1 is installed to the mounting part 3, the valve member 32 may be pushed up close to the opening 37*a* of the projection part 37 and may be caught by the opening 37*a*. When the ink cartridge 1 is detached from the mounting part 3 at this state, the valve member 32 is not in contact with the valve seat part 46*a*, thus causing the ink to leak.

In order to prevent this, in this variation, several pointed projections 71*a* are attached to the valve side wall 71 of the valve member 32 as shown in the FIG. 9, so that the friction between the top of the valve side wall 71 and the projection part 37 is increased and they remain attached even if the urging part 46*b* is extended.

Figure 10:
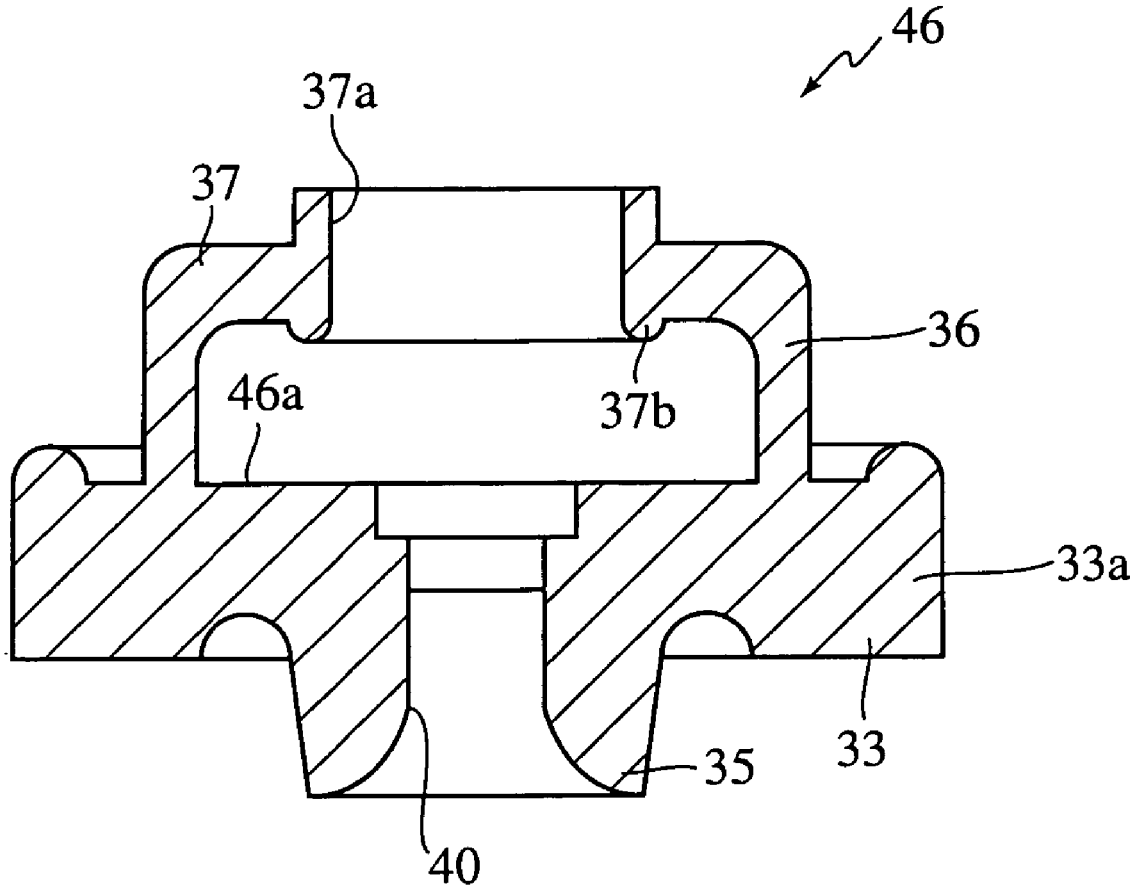
FIG. 10 is a sectional view of a holding member of an exemplary valve member according to the present invention.

FIG. 10 shows a ring-shaped projection 37*b* on the projection part 37 of the support member 46, which is added to achieve the same effect as noted above. This ring-shaped projection 37*b* is attached to circular valve side wall 71 of the valve member 32.

Based on these structures, and by adding the matching concave or convex parts on the valve member 32 and the projection part 37, both parts are prevented from making corresponding circular movements, thus preventing the valve member 32 from not returning to the closed position.

Figure 11A:
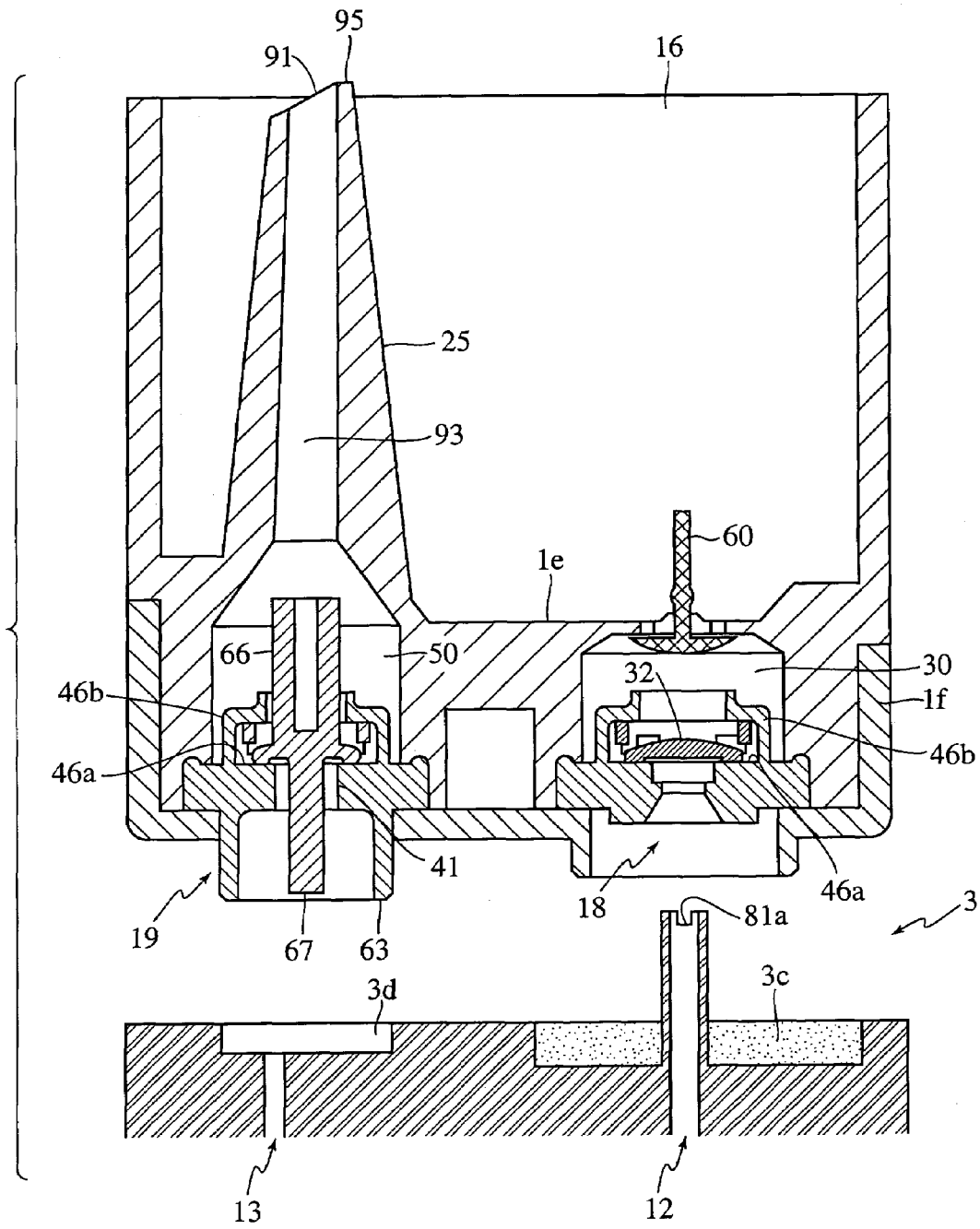
FIGS. 11A and 11B are sectional views of an exemplary ink cartridge according to the present invention.
Figure 11B:
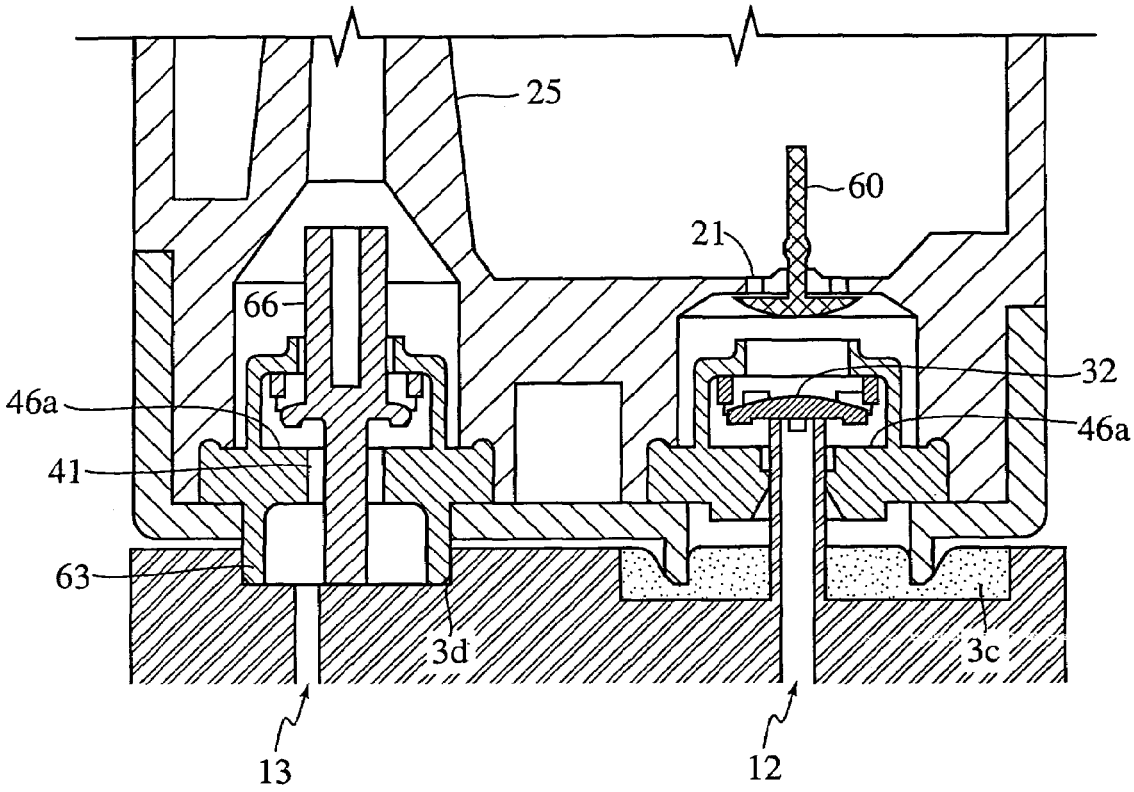

FIGS. 11A and 11B are cross-sections of the ink cartridge 1 and the mounting part 3 of the third embodiment. In this embodiment, the valve device 19 and the mounting part 3 of the ink jet recording device 2 differ from the second embodiment shown in FIG. 7. Since the valve device 18 is the same, the explanation of the valve device 18 is omitted.

The valve device 19 is equipped with the support member 46 and the valve member 32. The support member 46 is assembled using a rubber-like elastic material just as the support member 46 in the first and second embodiments, and is equipped with the valve seat part 46*a* and an urging part 46*b* on the top part. The structures of these parts are identical with the valve seat part 46*a* and the urging part 46*b* of the first and second embodiments.

In the middle of the valve seat part 46*a*, the opening 41 is formed to expose the center of the valve member 32 to the outside and, in the lower portion, a sealing part 63 which surrounds the opening 41 is projected toward the opposite side of the urging part 46*b*.

Figure 12A:
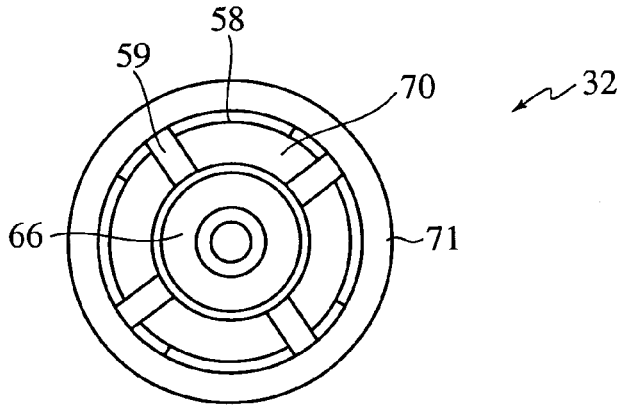
FIGS. 12A-12C depict the valve member of FIGS. 11A and 11B.
Figure 12B:
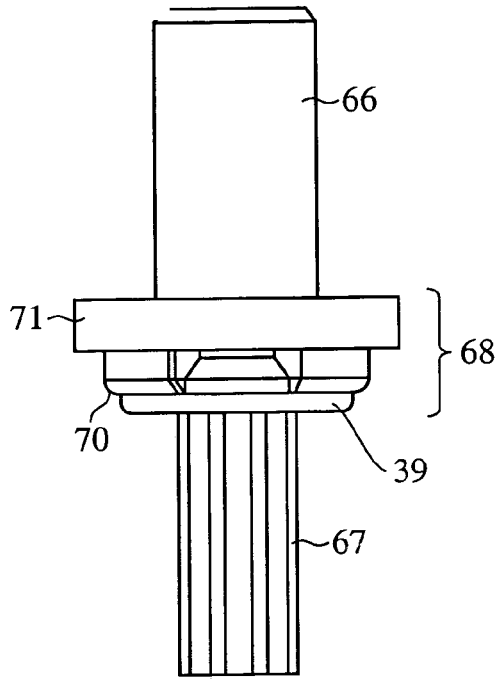
Figure 12C:
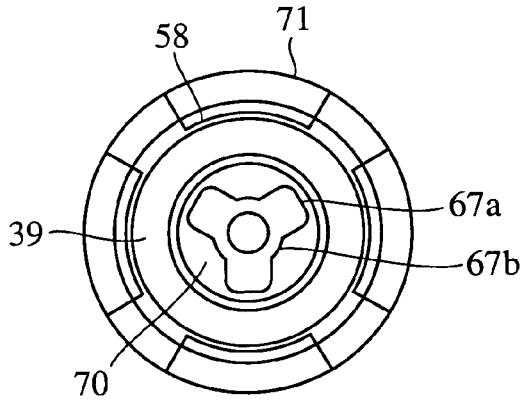

FIG. 12 shows the detail of the valve member 32. Just as the valve member shown in the FIG. 8, the valve member 32 is equipped with a valve 68 consisting of the bottom part 70 and the valve side wall part 71. The explanation of the detailed construction including communication paths 38 and projecting part 59 is omitted since they are explained in reference to FIGS. 8A-8E.

In this example, the bottom part 70 is attached with a cylindrical part 66 which stands vertically from the top surface. When the ink cartridge 1 is installed on the mounting part 3 in a normal manner and the valve member 32 is pushed upward from the valve seat part 46*a*, the top edge of the cylindrical part 66 is positioned apart from the inside surface of the barrel member 25 and thus the through-pass between the ink chamber 16 and the opening 41 of the valve seat part 46*a* is secured.

The bottom part 70 is attached with the operating member 67 which extends vertically from the opening 41 on the side being exposed. Several concave portions 67*a* and convex portions 67*b* are formed on the outer circumference of the operating member 67, which extend along the direction of the axis. This configuration, in which the operating member 67 is attached to, or formed integrally with, the valve member 32, provides distinct advantages over arrangements in which the operating member 67 is separate from the valve member 32. For example, in order for an operating member 32 to operate a valve, the operating member must be positioned in cooperation with the valve member 32. In configurations in which the operating member 67 is separate form the valve member 32, the position of the operating member 67 with respect to the valve member 32 must be carefully controlled because misalignment of the operating member 67 with respect to the valve member 32 could result in leakage and/or damage to the valve member 32. Such control is not necessary in configurations in which the operating member 67 is attached to, or formed integrally with, the valve member 32.

Moreover, in an apparatus including two or more valves (e.g., an ink cartridge with an air valve and an ink valve) that is used with a device (e.g., an image forming device) that communicates with the valves, it may be advantageous to provide valves of different types—that is, one or more valves can be provided having a configuration in which an operating member is attached to a valve member and one or more valves can be provided having a configuration in which an operating member is not attached to a valve member. In the instance in which a valve is provided having a configuration in which an operating member is not attached to a valve member, the operating member could be attached to the device at a specified location. As at least one of the valves includes an attached operating member, that valve would not be able to communicate with the device at the specified location because two operating members would be present. Such an arrangement will ensure that when the apparatus is installed in the device, each valve properly communicates with a respective region of the device.

FIG. 11A shows the state prior to the installation of the ink cartridge 1 onto the mounting part 3 of the ink jet recording device 2, and the lower edge of the operating member 67 is made so that it is positioned slightly above the lower edge of the sealing part 63. In this state, both the valve member 32 of valve device 18 and the valve member 32 of the valve device 19 are pressed against the valve seat part 46*a* of the support member 46 and thus each valve device is not released.

With respect to the mounting part 3 of the ink jet recording device 2, the ink extracting tube 12 is projected in the ink supplier part just as the first and second embodiments, and a porous body 3*c* such as sponge is attached around the ink extracting tube 12 so that the leakage of ink will be absorbed. In the outside air intake part, the convex part 3*d* is formed in such a way that it corresponds to the sealing part 63, and the air intake tube 13 is attached to the bottom surface of the concave part 3*d*.

As shown in FIG. 11B, when the ink cartridge 1 is installed, the tip, of the ink extracting tube 12 pushes the valve member 32 of the valve device 18 just as in the first and second embodiments, thus releasing the valve device 18.

In the outside air intake part, the tip of the operating member 67 touches the bottom of the concave part 3*d*, and the valve seat part 46*a* is moved downward while the valve member 32 is fixed, releasing the valve device. At the same time, the bottom edge of the sealing part 63 is attached to the bottom of the concave part 3*d*, and a passage is formed between the air intake tube 13 and the ink chamber 16 through the released valve device 19.

In the third embodiment, the valve member 32 equipped with the operating member 67 is installed only in the valve device 19. However, the valve member 32 equipped with the operating member 67 may also be installed in the ink supply part so that the ink extracting tube 12 does not project to the mounting part 3.

Figure 13:
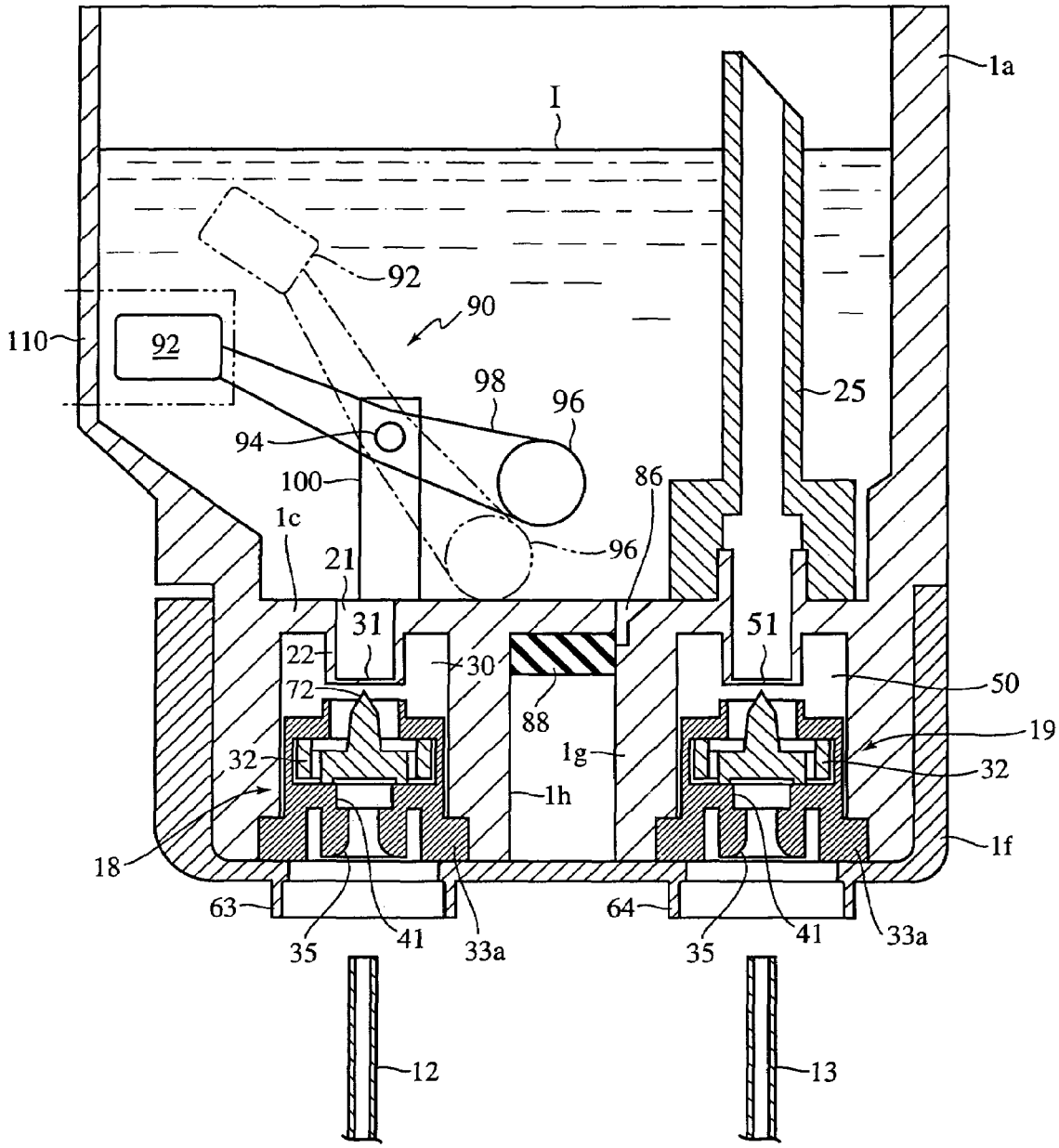
FIG. 13 is a sectional diagram showing the structure of an exemplary ink cartridge according to the present invention before the ink cartridge is loaded into an inkjet recording apparatus.

FIG. 13 is a sectional view of the ink cartridge 1 of a fourth embodiment. In this embodiment, a cover 1*f* covers a bottom area of the container wall 1*a* of the ink cartridge of FIG. 2. The ink cartridge 1 also includes two walls 1*g* and 1*h* similar to the ink cartridge 1 of FIG. 7 that form the barrel-shaped bodies 30 and 50 which are open downward. The valve device 18 is placed in the barrel-shaped body 30 and the valve device 19 is placed in the barrel-shaped body 50. The valve device 18 and the valve device 19 are identical to the valve devices of FIG. 2. Located opposite the positioning parts 33*a* of the valve devices 18 and 19, the cover 1*f* includes a cover 63 that covers the valve device 18 and a cover 64 that covers the valve device 19.

The ink cartridge 1 also includes an opening 86 that is formed in the partition wall 1*c* that allows ink I to be supplied to the ink chamber 16 during manufacturing. After the ink has been supplied to the ink chamber 16 and before the cover 1*f* is placed on the container wall 1*a*, a stopper 88 is placed against the partition wall 1*c* in order to cover the opening 86.

An ink detection level device 90 is located within the ink chamber 16. The ink detection level device 90 includes a support 100 that extends from the partition wall 1*c*, a blocking member 92 attached to an arm 98, a balance member 96 attached to an opposite end of the arm 98 and a pivot 94 attached to the support 100.

After the ink chamber 16 is filled with ink I, and when the ink cartridge 1 is held in an upright position, the blocking member 92 remains in the projection 110. While the blocking member 92 remains in the projection 110, a sensor (not shown) is able to detect the presence of the blocking member 92 so that a user is informed that the ink chamber 16 is full.

When the ink chamber 16 is emptied, the arm 98 rotates via the pivot 94 such that the balance member 96 eventually rotates toward and contacts the partition wall 1*c*. As such, the blocking member 92 eventually rotates to a position outside the indicated box area. The sensor is thus able to detect the absence of the blocking member 92 and inform the user that the ink chamber 16 is empty.

Figure 14A:
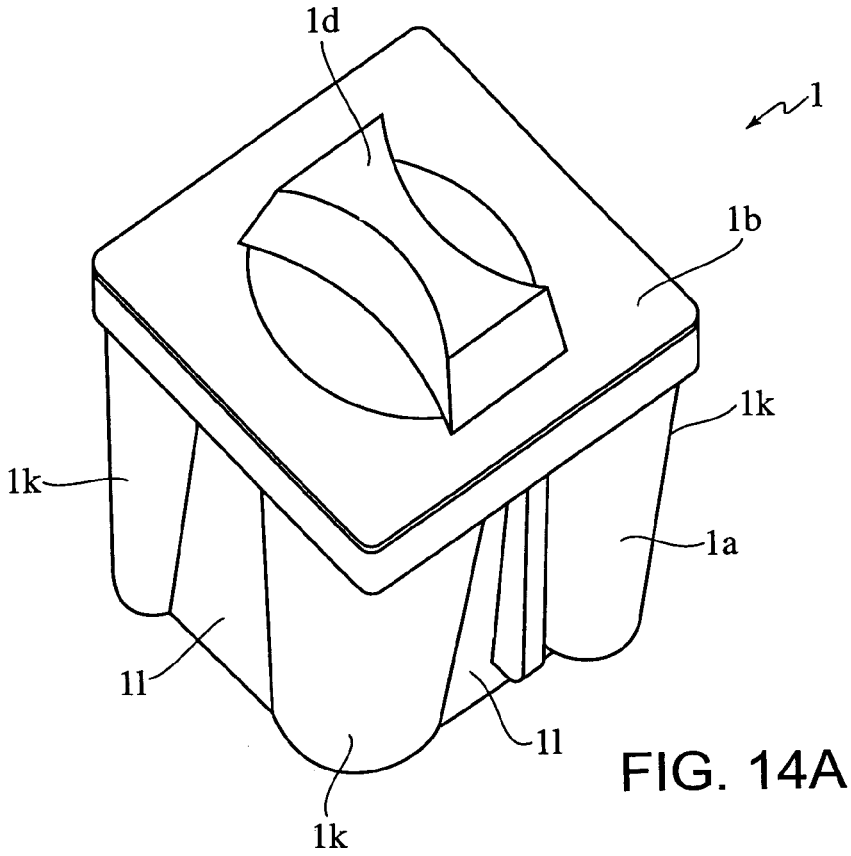
FIG. 14A is a perspective view of an exemplary ink cartridge according to the present invention from an upper direction.
Figure 14B:
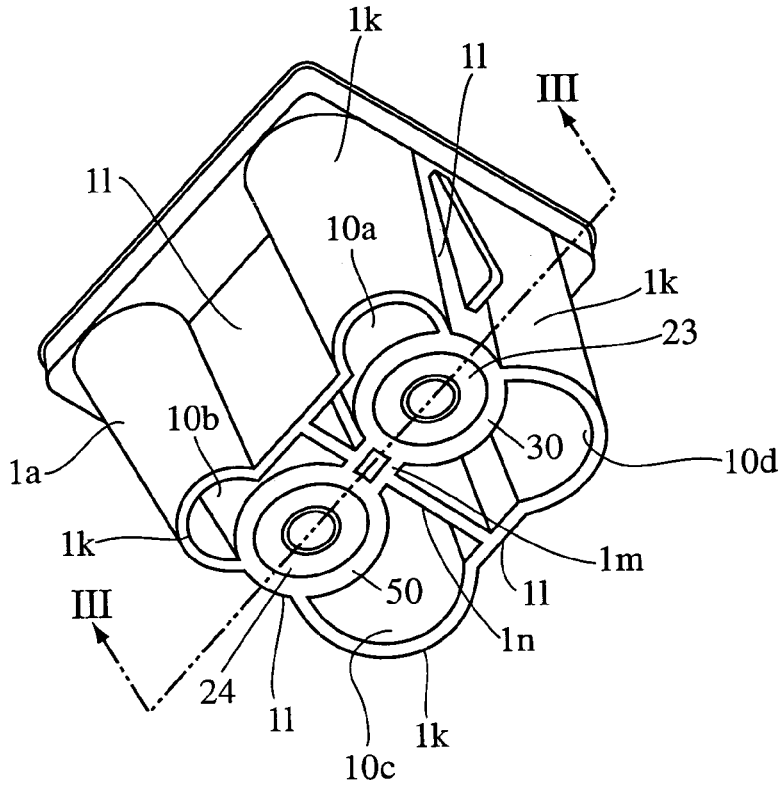
FIG. 14B is a perspective view of an exemplary ink cartridge according to the present invention from a lower direction.

FIGS. 14A and 14B are views of an ink cartridge 1 according to a fifth embodiment of the invention. FIG. 14A is a perspective view of the ink cartridge 1 from an upper direction, FIG. 14B is a perspective view of the ink cartridge 1 from a lower direction and FIG. 15 is a sectional view taken along a line III-III of FIG. 14B.

The ink stored in the ink cartridge 1 is deaerated ink on which deaeration processing has been performed, and the ink has been sealed in the ink cartridge. The ink is deaerated in order to suppress an emitting failure due to the existence of bubbles in ink within the ink chamber 16.

The ink cartridge 1 includes the container wall 1*a* in which the upper/lower end surfaces are open, and the lid 1*b* which is fixed in order to cover the opening on the top surface of the container wall 1*a*. The lid 1*b* is provided with a gripping part 1*d* which is outwardly protruded in order to improve operability when the ink cartridge 1 is detached from/attached to the inkjet recording apparatus 2. Furthermore, the container wall 1*a* and the lid 1*b* are formed of a resin material.

Figure 15:
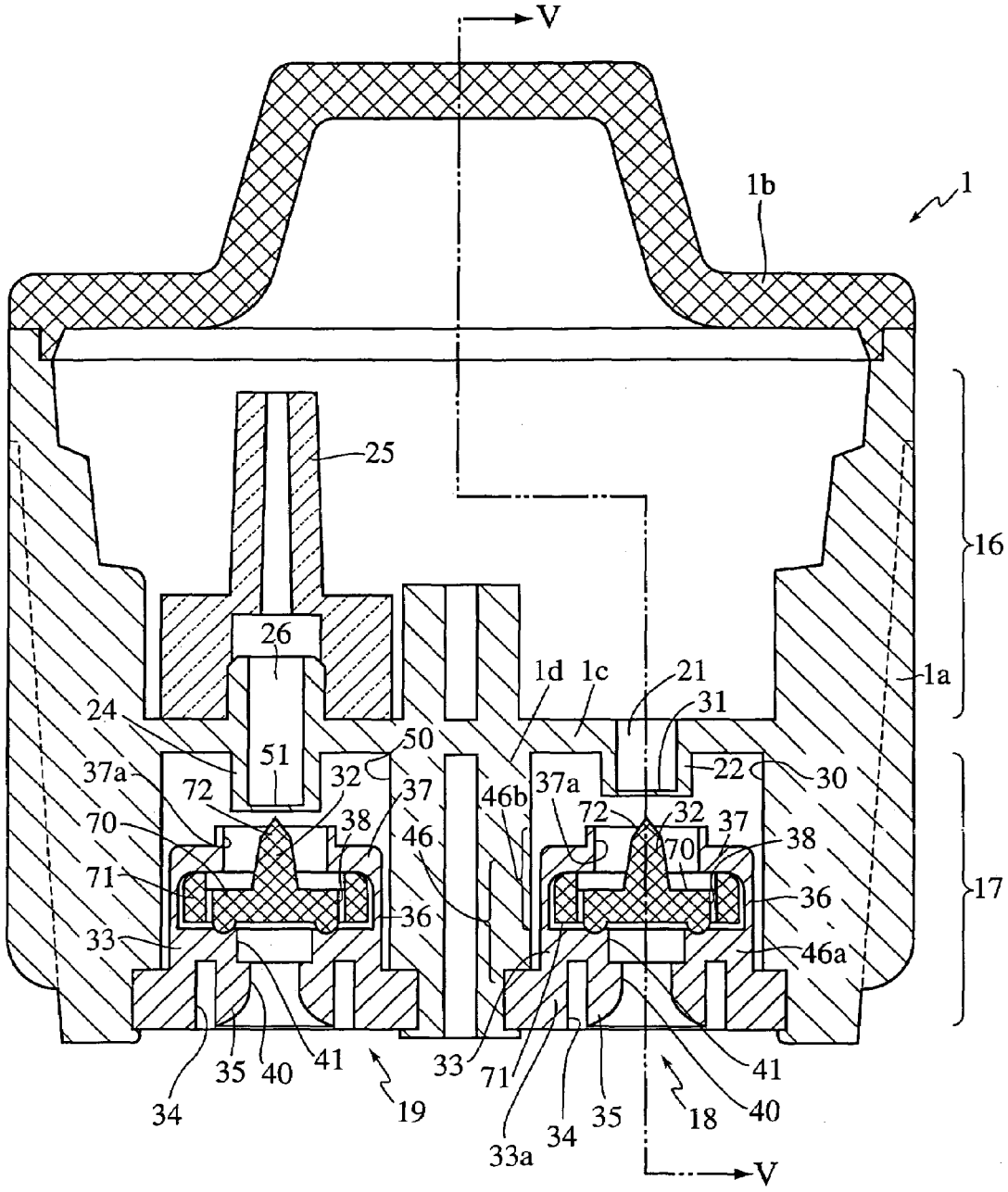
FIG. 15 is a sectional view taken along a line III-III of FIG. 14B.

As shown in FIG. 15, the partition wall 1*c* divides the inside of the ink cartridge 1 into two spaces and is formed integrally with the container wall 1*a*. Within these two spaces, the space between the partition wall 1*c* and the top opening covered by the lid 1*b* (i.e., the top portion) is formed as the ink chamber 16 which stores ink, and the space between the partition wall 1*c* and the lower opening (i.e., the bottom portion) is formed as a second chamber 17. The partition wall 1*c* extends perpendicular to the center axis direction of the container wall 1*a* at a substantially intermediate position between the top opening and the bottom opening. Because of this, the ink cartridge 1 is supported from the inside by the partition wall 1*c* at the substantially intermediate position of the ink cartridge 1. Thus, pressure resistance against a pressure to be added toward the inside from the outside of the ink cartridge 1 improves, and deformation and damage of the ink cartridge 1 can be suppressed.

Additionally, the container wall 1*a* forms a substantially rectangular shape in horizontal cross-section, but the four corners are formed with substantially cylindrical curved walls 1*k*, and the side surfaces between the curved walls 1*k* are formed as concave parts 1*l* facing outward. By so doing, the rigidity of the ink cartridge 1 with respect to the above-mentioned pressure is improved.

On the partition wall 1*c*, the barrel-shaped body 30, which extends toward the opening of the second chamber 17, is connected and formed so as to protrude into the second chamber 17 from the partition wall 1*c* and surround the cylindrical wall 22. In addition, on the partition wall 1*c*, the second barrel-shaped body 50, which extends toward the opening of the second chamber 17, is connected and formed so as to protrude toward the second chamber 17 from the partition wall 1*c* and surround the cylindrical wall 24.

The outside surface of the barrel-shaped body 30 and the outside surface of the second barrel-shaped body 50 are connected to a pair of side surfaces of the container wall 1*a*, respectively. The barrel-shaped body 30 and the second barrel-shaped body 50 are mutually connected to a connecting member 1*m*. Additionally, the connecting member 1*m* is connected to a pair of side surfaces different from the above-mentioned pair of side surfaces by a connecting member 1*n*. Because of this, the second chamber 17 is divided into four spaces 10*a*, 10*b*, 10*c*, 10*d* (see FIG. 14B) by the interconnected barrel-shaped body 30, second barrel-shaped body 50, and connecting members 1*m*, 1*n*. That is, the barrel-shaped body 30, the second body-shaped body 50, and the connecting members 1*m*, 1*n* function as a support member which support the container wall 1*a* from the inside, so that pressure resistance of the container wall 1*a* improves with respect to a pressure that is added to the inside from the outside of the ink cartridge 1. Damage and deformation of the ink cartridge 1 can thus be suppressed.

Figure 16:
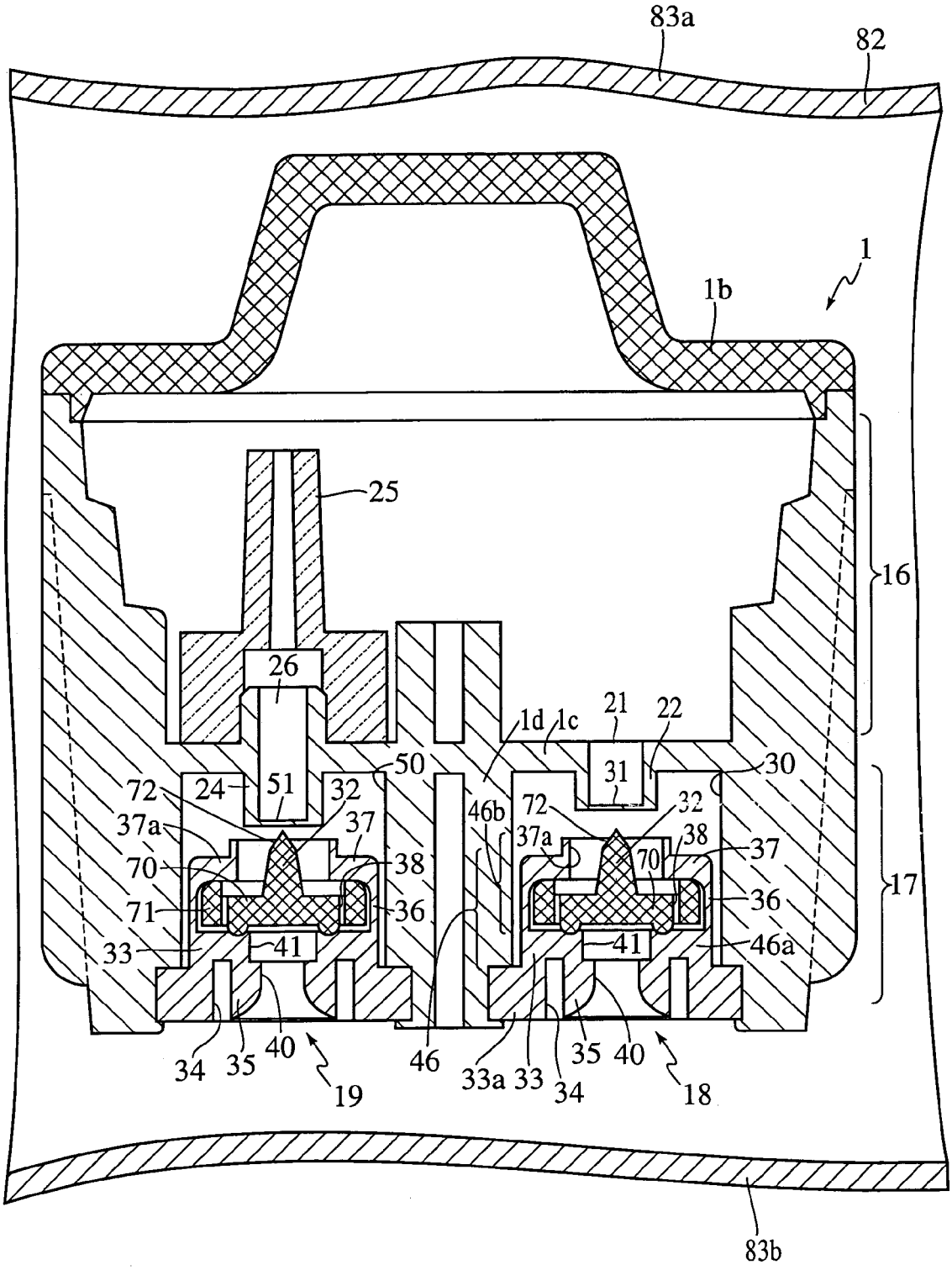
FIG. 16 is a sectional view of the ink chamber of FIG. 15 during a state when the ink cartridge is packaged.
Figure 17:
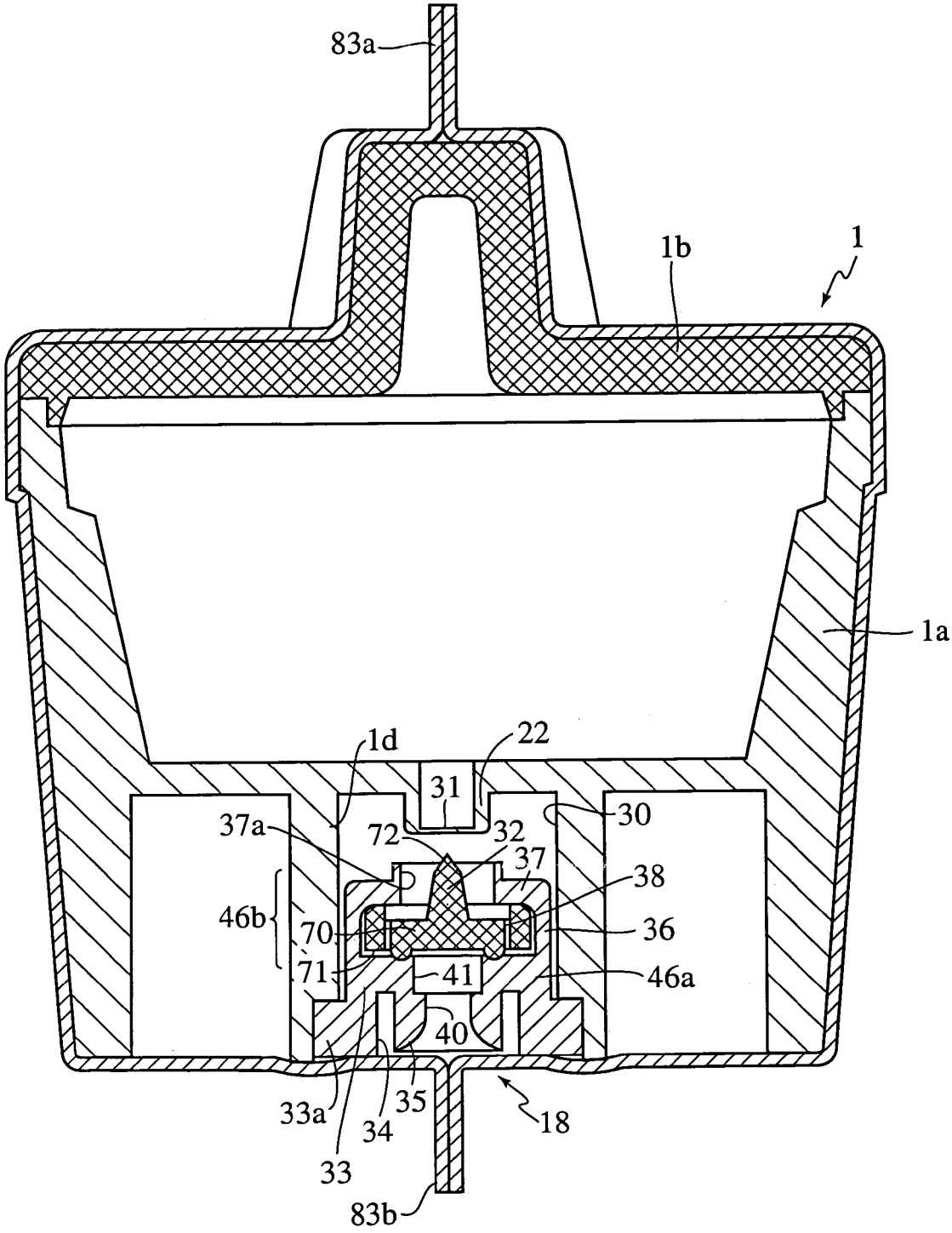
FIG. 17 is a sectional view taken along a line IV-IV of FIG. 15.

Next, a procedure for packaging the ink cartridge 1 into a packaging member 82 is explained with reference to FIGS. 16 and 17. FIGS. 16 and 17 are sectional views showing a state after a packaging body of the ink cartridge 1 is manufactured.

The packaging member 82 includes the ink cartridge 1 inside which deaerated ink is stored. The packaging member 82 is composed of a cylindrical seal material, and is provided with a shielding layer which suppresses humidity and air penetration. The shielding layer has a laminated structure in which a plurality of film sheets are laminated. In a state in which the ink cartridge 1 is contained, both end parts (hereafter referred to as "fused parts") 83*a*, 83*b* of the packaging member 82 are fused together, forming a bag shape. In order to maintain a sufficient degree of deaeration of the ink cartridge 1, the pressure is reduced between the ink cartridge and the packaging member 82.

The sheet material which constitutes the packaging member 82 includes, for example, laminating, in order, an adhesive layer and a nylon layer (external surface layer) on one side of an aluminum alloy layer, and an adhesive layer, a polyethylene terepthalate layer, an adhesive layer, and a polypropylene layer (internal surface layer) on the other side of the aluminum alloy layer.

In terms of manufacturing the packaging body of the ink cartridge 1 in which the ink cartridge 1 is contained, within a space in which pressure is reduced by a vacuum pump or the like so as to be a vacuum or an atmosphere close to a vacuum state, the ink cartridge 1 in which deaerated ink is stored is inserted into the packaging member 82. One of the fused parts 83*a* of the packaging member 82 is thermally fused in advance, and the other fused part 83*b* is open. Then, the other fused part 83*b* of the packaging member 82 is thermally fused. When the fused part 83*b* is formed and sealed, and the packaging is completed (the states of FIGS. 16 and 17). The ink cartridge 1 is thus sealed in the packaging member 82.

Thus, pressure is constantly applied inward from the outside of the ink cartridge 1. However, in the ink cartridge 1, the partition wall 1*c* is arranged at the substantially intermediate position between the two openings of the container wall 1*a*, so that the ink cartridge 1 can tolerate the pressure applied to the ink cartridge 1. Damage and deformation of the ink cartridge 1 can thus be prevented. Rigidity of the ink chamber 16 is improved by the partition wall 1*c*, the lid 1*b* fixed to the upper end opening, and the curved walls 1*k*. Furthermore, with respect to the second chamber 17, the barrel-shaped body 30 and the second barrel-shaped body 50 are connected to a pair of side surfaces of the respective container wall 1*a* and are also connected to another pair of side surfaces by the connecting members 1*m*, 1*n*. Thus, the pressure resistance of the second chamber 17 of the ink cartridge 1 can be improved. Deformation and damage of the ink cartridge 1 can thus be reliably suppressed.

Therefore, damage and deformation of the ink cartridge 1 which causes ink leakage from the ink chamber 16, and which creates a shape of the ink cartridge 1 which cannot be mounted to the inkjet recording apparatus 2 due to damage and deformation can be reliably suppressed.

Also, while in the above example the outer shape of the valve devices 18 and 19 are made slightly smaller than the inside shape of the barrel-shaped bodies 30 and 50 and are fixed through the pressure from the holding wall 42, the outer shape of the valve devices 18 and 19 can be made slightly larger than the inside shape of the barrel-shaped bodies 30 and 50 and the valve devices 18 and 19 may be fixed by driving them into the through-chamber.

Figure 18:
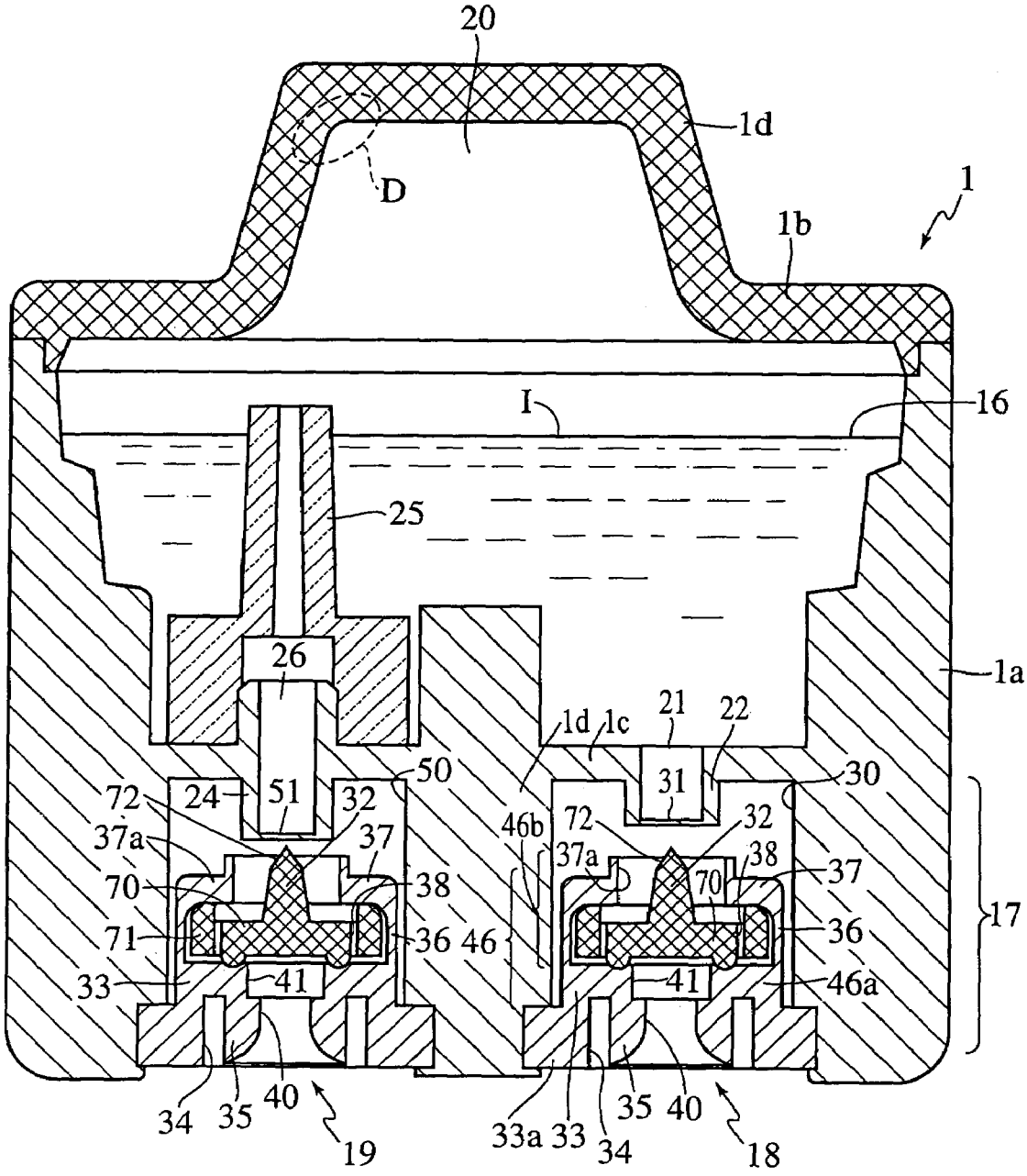
FIG. 18 is a sectional diagram of an exemplary ink cartridge according to the present invention.
Figure 19A:
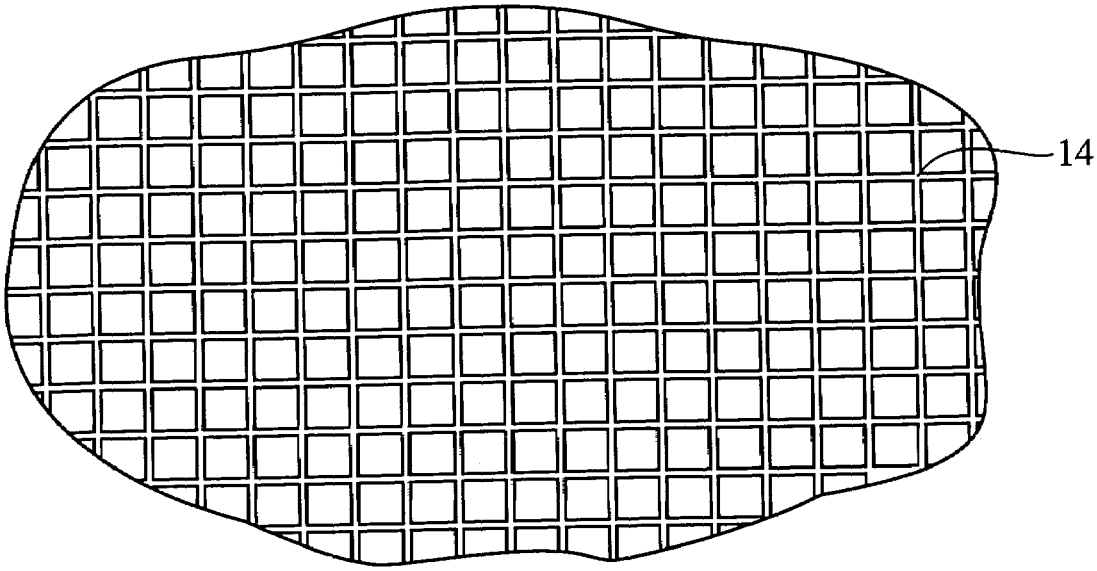
FIG. 19A is an enlarged diagram showing an inner wall surface of an exemplary ink cartridge according to the present invention.
Figure 19B:
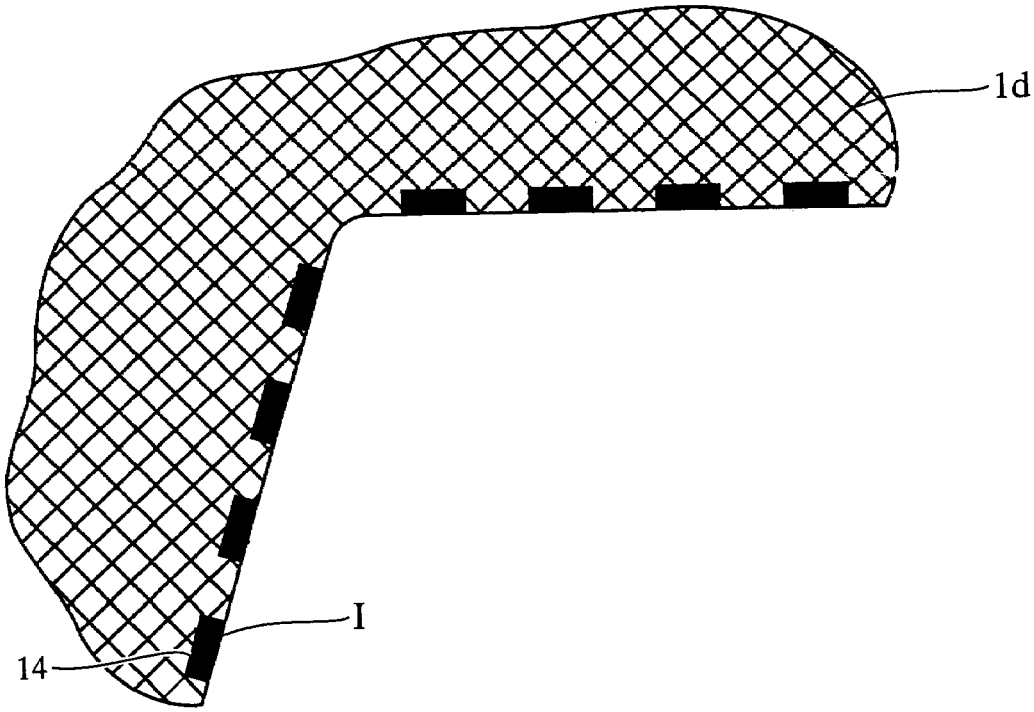
FIG. 19B is an enlarged cross-sectional diagram showing part D in FIG. 18.

FIGS. 18-19B are views of an ink cartridge 1 according to a sixth embodiment of the invention. FIG. 18 is a sectional diagram of the ink cartridge 1, FIG. 19A is an enlarged diagram showing an inner wall surface, and FIG. 19B is an enlarged cross-sectional diagram showing part D in FIG. 18; and As shown in FIG. 18, the ink cartridge 1 includes the substantially cylindrical container wall 1*a* in which the upper/lower end surfaces are open, and a lid 1*b* which is fixed in order to cover and seal the opening on the top surface of the container wall 1*a*. The lid 1*b* is provided with the gripping part 1*d* which protrudes outwardly in order to improve operability when the ink cartridge 1 is detached from/attached to the inkjet recording apparatus 2. The inside of the gripping part 1*d* is formed in a hollow shape, and on the inner wall surface of the lid 1*b*, mesh shaped dispersing grooves 14 are formed to hold the ink I by capillary action in a state where the ink is dispersed in a first direction and a second direction perpendicular to the first direction (see FIGS. 19A and 19B). These dispersing grooves 14 will be described later. As shown in FIG. 18, the container wall 1*a* and the lid 1*b* are formed of a resin material. The ink I to be supplied to the recording head 7 is stored in the ink chamber 16 formed inside the ink cartridge 1. The container wall 1*a* and the lid 1*b* are formed from a transparent or semi-transparent resin material, and structured to allow the color of the ink I stored in the ink chamber 16 to be recognized.

As shown in FIG. 18, the partition wall 1*c* divides the inside of the ink cartridge 1 into two spaces and is formed integrally with the container wall 1*a*. Within these two spaces, the space between the partition wall 1*c* and the top opening covered by the lid 1*b* (i.e., the top portion) is formed as the ink chamber 16 which stores ink, and the space between the partition wall 1*c* and the lower opening (i.e., the bottom portion) is formed as a second chamber 17.

The ink I in the ink chamber 16, that is partitioned by the partition wall 1*c*, is supplied up to a position near the top surface of the container wall 1*a*. As a result, a space 20 that does not contain the ink I is formed on the top side of the ink chamber 16 when the ink cartridge 1 is installed in the inkjet recording apparatus 2. In this space 20, the hollow part formed by a hollow shape inside the gripping part 1*d* is also included.

Next, the dispersing grooves 14 formed on the inner surface of the gripping part 1*d* are described with reference to FIGS. 19A and 19B. FIGS. 19A and 19B are diagrams showing the structure of the dispersing grooves 14. FIG.

19A is an enlarged diagram showing the inner wall surface of the gripping part 1*d* and FIG. 19B is an enlarged cross-sectional diagram showing part D in FIG. 18.

On the some or all of the inner wall surface of the lid 1*b*, square-shaped protruding parts are positioned at an equal distance in the first direction and the second direction from each other as shown in FIG. 19A, and grooves are formed between the square-shaped projecting parts. These grooves are laid in the in the first direction and the second direction in a square mesh shape to form the dispersing grooves 14. The ink I that adheres on the inner wall surface of the lid 1*b* enters into these dispersing grooves 14 and is held within these grooves in a state such that the ink I is dispersed in the vertical and horizontal directions by capillary action. This stage is shown in FIG. 19B.

As shown in FIG. 19B, ink I in the dispersing grooves 14 is held by capillary action. Ink I is held by capillary action even if the space 20, which does not contain the ink, is formed inside the gripping part Id as a result of the user holding the gripping part 1*d* to install the ink cartridge 1 into the inkjet recording apparatus 2 and the container wall 1*a* is on the lower side and the lid 1*b* is on the upper side. In this case, the ink I does not flow out from the dispersing grooves 14.

The dispersing grooves 14 are formed in a square mesh shape by fine grooves, and ink I is held in these dispersing grooves 14. Therefore, when the user views the ink cartridge 1 from outside, the ink I can be recognized as the ink I forms a thin film that adheres to the inside the lid 1*b*.

The container wall 1*a* is formed by the same transparent or semi-transparent material as the lid 1*b*. However, if the ink I is gathered at a predetermined volume in the ink chamber 16, the color of the ink I darkens and has a blackened color. For instance, when the ink I of cyan or magenta is stored, the color of the ink I becomes almost black. When the ink I in yellow is stored, the ink I becomes almost a red-black. Therefore, it becomes difficult for the user to accurately determine the color of the ink I.

However, because the ink cartridge 1 is formed with the space 20, which does not contain the ink I, and the dispersing grooves 14 on the inner wall surface of the lid 1*b* form a part of the space 20, and because the ink I is held in the dispersing grooves 14 in a substantially thin film state, the color of the ink I stored in the ink chamber 16 can be accurately recognized.

As explained above, according to the ink cartridge 1 described above, the lid 1*b* is formed to have some transparency, and the ink I flows into the dispersing grooves 14 formed on the inner wall surface of the gripping part 1*d* in a state that the ink I is dispersed in the vertical and horizontal directions. The dispersing grooves 14 are formed in a square mesh shape with fine grooves, and the space 20 that does not contain the ink I is formed inside the gripping part 1*d*. Therefore, the user can accurately recognize the color of the ink I in the ink cartridge 1 without any errors. Therefore, the ink cartridge 1, in which different colors of ink I are respectively stored, can be prevented from being installed in an incorrect position when installed in the inkjet recording apparatus 2.

Moreover, because the ink cartridge 1 is formed from a transparent or semi-transparent resin material, it is not necessary, as done conventionally, to manufacture a different cover member for each color of ink I. Therefore, parts for manufacturing the ink cartridge 1 can be shared. As a result, complicated manufacturing processes for manufacturing the ink cartridge by selecting a lid 1*b* corresponding to the color of ink I can be omitted, and thus, the manufacturing process for manufacturing the ink cartridge 1 can be simplified, resulting in a reduction in the manufacturing cost of the ink cartridge 1.

Modified examples of the dispersing grooves 14 are described with reference to FIGS. 20A-20D. FIGS. 20A-20D are diagrams showing various formations of dispersing grooves 14.

Figure 20A:
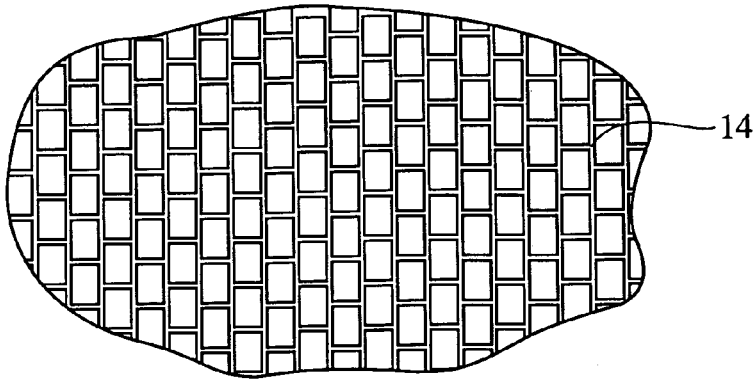
FIGS. 20A-20D are diagrams showing various exemplary dispersing grooves according to the present invention.
Figure 20B:
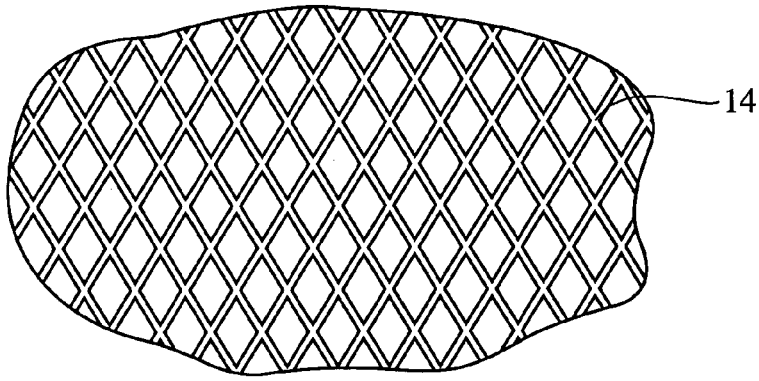
Figure 20C:
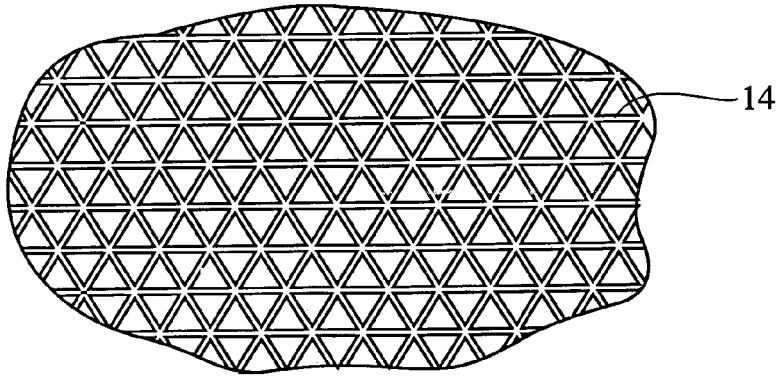
Figure 20D:
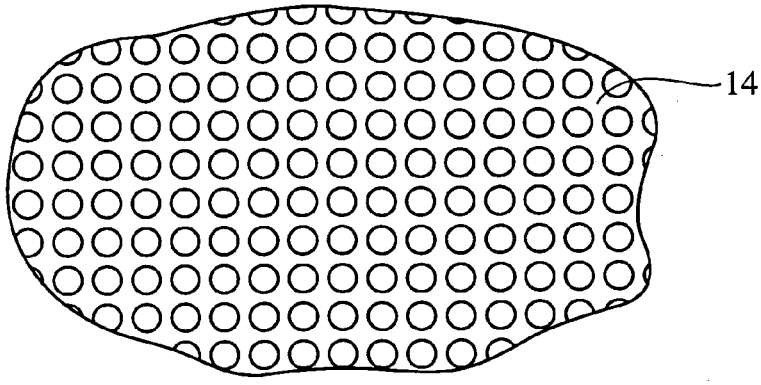

The dispersing grooves 14 shown in FIGS. 19A and 19B are formed in the square mesh shape. However, the dispersing grooves 14 could spread in the vertical and horizontal directions in a deformed rectangular mesh shape as shown in FIG. 20A, or in a parallelogram mesh shape as shown in FIG. 20B. In addition, the dispersing groove could spread in the vertical and horizontal directions in a triangular mesh shape as shown in FIG. 20C, or in a substantially circular mesh shape as shown in FIG. 20D in which the dispersing grooves 14 can be formed between many fine protruding parts having a substantially circular shape. The ink I adhered on the inner wall surface can be held also in the dispersing grooves 14 shown in FIG. 20A-20D in a state that the ink I is dispersed in each groove. That is, as long as the dispersing grooves 14 have grooves that can hold the adhered ink I, the shape thereof is not particularly limited.

As should be appreciated, various modifications are available. For example, in the above-described embodiments, the dispersing grooves 14 are formed on the inner wall surface of the lid 1*b*. However, the dispersing grooves 14 can be formed only on a part of the gripping part 1*d*. In addition, the dispersing grooves 14 can be formed on only the upper part of the container wall 1*a* or on the entire inner wall surface of the container wall 1*a*. Furthermore, the dispersing grooves 14 can be formed on the inner wall surface of the sidewall of the ink cartridge 1 in an area visible by the user.

Furthermore, in the above-described embodiments, the ink cartridge 1 having a structure in that the lid 1*b* becomes the upper part in a state that the ink cartridge 1 is installed in the inkjet recording apparatus 2 is employed. However, an ink cartridge having the lid on the sidewall or an ink cartridge formed in a substantially box shape that does not have the lid in a state that the ink cartridge is installed in the inkjet recording apparatus, may be used. Therefore, the structure of the ink cartridge is not limited. In this case, the dispersing grooves 14 are formed on the inner wall surface of the sidewall of the ink cartridge that becomes at least the upper part in a state that the ink cartridge 1 is installed in the inkjet recording apparatus 2.

Furthermore, in the above-described embodiments, the container wall 1*a* and the lid 1*b* are both formed from a transparent or semi-transparent resin material. However, only the lid 1*b* may be formed by the transparent or semi-transparent resin material, or only the gripping part 1*d* may be formed by the transparent or semi-transparent resin material. In addition, materials through which the ink color can be transparently visible, such as materials having a milk-white color, are included in the "transparent or semi-transparent" materials described in this invention.

According to an exemplary aspect of the invention, when an ink cartridge is attached to an inkjet recording device, the valve member resists the urging force of the urging member (i.e., projecting component). Communication is thereby established between an ink chamber and a flow path provided in the inkjet recording device. In a state in which the ink cartridge is removed from the inkjet recording device, the valve member is brought into direct contact with the valve seat by the urging device, and leakage of ink through the opening is prevented.

Additionally, the urging device and valve seat are constructed from a rubber, elastic material in an integrated form in order to serve as a supporting member. Consequently, when the ink cartridge is discarded, for example, in the case of disposal by incineration, incineration is possible without modification, and there is no need for an operation to disassemble the ink cartridge and remove the metal compression spring, as in instances when a metal compression spring is used, and the resulting effect is that the operational efficiency is increased, and disposal costs are reduced.

Additionally, the valve member is held between the supporting member and the device. As a result, communication and obstruction can be carried out between the ink chamber and the flow path on the inkjet recording device side by disposing the supporting member in the communicating chamber in a state holding the valve member. Consequently, there is no need for a troublesome operational process of attaching an urging device that urges the valve member in the region where the valve member is provided, and the resulting effect is that ink cartridge manufacturing costs can be reduced.

According to an exemplary aspect of the invention, a valve member is brought into direct contact with the valve seat by the urging device, the ink flow path is obstructed reliably.

According to an exemplary aspect of the invention, an opening of a valve member communicating path is formed non-circularly, with the resulting effect that formation of a meniscus by surface tension of the ink and obstruction of said opening is prevented, and a smooth flow of ink is assured. If the opening of the communicating path were formed in approximately circular form, a meniscus would form readily, with a risk that ink flow would be obstructed.

According to an exemplary aspect of the invention, when a valve member is moved towards the ink chamber side, the rising portion of the urging device is readily extended and contracted, facilitating opening/closing operation of the valve member.

According to an exemplary aspect of the invention, a thickness of a portion of a urging device at the outer periphery of the valve member is formed thinner than the thickness in the direction of penetration of the valve seat hollow member, with the resulting effect that when the valve member moves, deformation of the valve seat is small, and the urging device undergoes great elastic deformation on the ink chamber side, and consequently, communication is brought about reliably between the ink chamber and the flow path on the inkjet recording device side.

According to an exemplary aspect of the invention, an inner periphery of an edge forming the penetration side of the hollow member of the sealing means is structured such that the diameter is smaller increasingly from the penetration side towards the valve member side, with the resulting effect that a hollow member with an outer diameter formed larger than the inner diameter of the sealing means is made to penetrate smoothly, and crimping is brought about reliably.

According to an exemplary aspect of the invention, inclination of a sealing member in conjunction with elastic deformation of the inner peripheral surface of the sealing means is prevented, and obstruction of the flow path communicating between the ink chamber and the hollow member is also prevented.

According to an exemplary aspect of the invention, in a state in which the valve member is made to contact the valve seat directly by means of the urging device, communication between the ink chamber side and the sealing means side is reliably obstructed by the projecting member. Ink leakage is thus prevented more reliably.

According to an exemplary aspect of the invention, when the valve member separates from the valve seat, disconnection of the valve member from the projecting portion of the impeller is prevented by the concavity and convexity.

According to an exemplary aspect of the invention, the insertion position of the supporting member is determined more reliably by the attachment part and the stepped surface, and operational efficiency during ink cartridge manufacturing is improved.

According to an exemplary aspect of the invention, the formation of a meniscus by the surface tension of the liquid is prevented, and a smooth flow of the liquid is assured.

As mentioned above, in Japanese Unexamined Patent Application Publication H3-197052, for example, the protection device requires a protection plate, a lock component, and twisted coil spring. As such, it is necessary to secure space in the inkjet recording apparatus in order to install each component. The inkjet recording apparatus is thus bigger and manufacturing costs increase due to the increased number of components.

Embodiments of this invention thus provide an ink cartridge that can supply the ink safely without any specific safety device installed at the inkjet recording apparatus.

An ink cartridge according to an exemplary aspect of the invention includes an ink chamber that can store ink; a communication chamber with an opening that can receive an extract component; a film component that blocks communication between the communication chamber and the ink chamber; and a breaking component, which is positioned at the communication chamber, that can rupture the film component when the extract component is moved into the communication chamber.

An ink cartridge according to an exemplary aspect of the invention includes an ink chamber that can store ink; a communication chamber with a first opening that communicates with the ink chamber and a second opening that can receive an extract component; a valve that is positioned between the first opening and the second opening; and a support that supports a bottom surface of the valve, wherein an ink passage is formed between the valve and the support when an extract component is inserted into the communication chamber.

According to an exemplary aspect of the invention, it is not necessary to make the tip of an extract component acuminate. Therefore, the user will not be hurt by the extract component projecting from the inkjet recording apparatus, and thus the safety is improved. At the same time, it is not necessary to install a protection device to protect the extract component on the side of the inkjet recording apparatus, which has an effect of reducing production costs.

According to an exemplary aspect of the invention, work processes that are used to adhere a film component after an ink cartridge is manufactured is shortened. In this regard, there is an effect to improve the efficiency of a manufacturing operation. According to an exemplary aspect of the invention, it is also possible to avoid using a film component.

According to an exemplary aspect of the invention, a breaking component is formed in an acuminate form toward a film component, and therefore, there is an effect that it can reliably rupture the film component when it is pushed by an extract component toward the side of the film component.

According to an exemplary aspect of the invention, grooves are formed to form a passage for ink to flow between a breaking component and a film component. There is thus an effect in that an ink passage that connects the ink chamber and the communicating chamber is reliably formed by the grooves.

According to an exemplary aspect of the invention, multiple grooves are formed, and such multiple grooves are formed at approximately even intervals on an external wall of a breaking component. It is thus possible to form more ink passages connecting the ink chamber with the communicating chamber. Therefore, there is an effect that the ink can be supplied constantly to the extract component.

According to an exemplary aspect of the invention, it is possible to widen ink passages connecting an ink chamber and a connecting chamber further and supply ink constantly. In addition, there is an effect to prevent the breaking component from being immovable from the film component when an ink cartridge is attached and removed.

According to an exemplary aspect of the invention, a valve component is positioned in a communicating chamber closer to the side of the opening rather than the breaking component and therefore, it is possible to either communicate or shut off the ink passages by the valve component after the breaking component ruptures the film component and the communication between the ink chamber and the communicating chamber is opened. In this regard, there is an effect to prevent the ink from leaking when an ink cartridge is attached or removed.

According to an exemplary aspect of the invention, since a valve component and the breaking component are formed as a unit with each other, there is an effect to decrease the number of components and thus reduce the production cost.

According to an exemplary aspect of the invention, when an ink cartridge is loaded into the inkjet recording apparatus, the first film component is broken off after the second film component on the side of the air intake component is broken off first so that air is supplied to the ink chamber and the ink is supplied to the recording head smoothly.

According to an exemplary aspect of the invention, since a second valve component, which selectively communicates and blocks off the ink passages by the air intake component, is positioned on the opening side rather than the second breaking component side in the air intake chamber, communication and blocking off of the ink passages can be selected by the second valve component once the second film component is broken off and the communication between the ink chamber and the air communicating chamber is opened. Thus, there is an effect to be able to prevent the ink from leaking when an ink cartridge is attached and removed.

According to an exemplary aspect of the invention, since a second valve component and the second breaking component are formed as a unit with each other, there is an effect to decrease the number of components and thus reduce the production cost.

According to an exemplary aspect of the invention, there is an effect to be able to reliably prevent the ink from leaking from the communicating chamber while an ink cartridge is attached or removed since the valve component is biased in the direction of the valve seat unit from the ink chamber side due to the biasing unit.

According to an exemplary aspect of the invention, there is an effect to be able to reliably prevent the ink from leaking from the communication chamber while an ink cartridge is attached or removed since the second valve component is biased in the direction of the second valve seat unit from the ink chamber side due to the biasing unit.

According to an exemplary aspect of the invention, a tube unit, a biasing unit and a valve seat unit are manufactured by elastic materials like rubber as a unit with each other. Therefore, when an ink cartridge is discarded, for example when it is discarded by incineration, it can be incinerated and it is not necessary to disassemble the ink cartridge to take out a compression spring made of metals, and thus, there is an effect to be able to improve the efficiency of operation and reduce the disposal cost.

According to an exemplary aspect of the invention, it is possible to open or block off communication between an ink chamber and the outside by positioning a supporting component that is in the state of holding a valve component in the communicating chamber. Thus, a complicated operating process of installing a biasing means to bias the valve component in the field where the valve component is positioned can be eliminated, and therefore, there is an effect to be able to reduce the manufacturing cost of the ink cartridges.

Furthermore, the above described ink cartridges, in Japanese Laid-Open Patent Application No. 9-20018 for example, prevent misinstallation in inkjet recording apparatus by employing cover members formed from materials that are the same color as the ink stored therein. However, because such cover members are formed in different colors corresponding to various ink colors, the number of parts necessary to manufacture ink cartridges increases, and manufacture must include selecting cover members that correspond to colors of ink used in such cartridges, thus complicating manufacturing processes. Accordingly, manufacturing costs for ink cartridges increases.

In ink cartridges formed from transparent or semi-transparent materials, the stored ink can be recognized when viewing such cartridges. However, if ink is collected at a predetermined volume in such ink cartridges, the color of the ink is dark. As a result, it can be difficult to accurately recognize the color of the ink stored in such ink cartridges.

Embodiments of the present invention include ink cartridges, in which manufacturing costs are reduced by using fewer parts during manufacture of such ink cartridges, and by which the color of the ink in such cartridges can be accurately recognized. Embodiments of the present invention further include inkjet recording apparatus in which ink cartridges can be installed.

In exemplary embodiments, ink cartridges include an ink chamber that can store ink. Ink chambers can include an upper part and a lower part with the lower part storing ink and the upper part including a space that does not contain ink. In exemplary embodiments, at least one part of an upper part is formed of a transparent or semi-transparent material, and grooves can be provided on an inner wall surface of the at least one part, the grooves being designed to hold the ink on the inner wall surface by capillary action such that the ink is dispersed in vertical and horizontal directions.

In exemplary embodiments, ink cartridges include an ink chamber that can store ink, wherein an upper end of the ink chamber is open and a cover covers the upper end. In exemplary embodiments, a space that does not contain the ink can be present between an inner wall surface of a cover and stored ink, at least one part of the cover being formed from a transparent or semi-transparent material. In exemplary embodiments, grooves can be provided on the inner wall surface, the grooves being designed to hold ink on the inner wall surface by capillary action such that ink is dispersed in vertical and horizontal directions.

In exemplary embodiments, ink cartridges can include an ink chamber that can store ink and a gripping part projecting outwardly from a cover. In exemplary embodiments, a space that does not contain ink can be present between an inner wall surface of the gripping part and the ink, at least one part of the gripping part being formed from a transparent or semi-transparent material. In exemplary embodiments, grooves can be provided on the inner wall surface, the grooves being designed to hold ink on the inner wall surface by capillary action such that the ink is dispersed in vertical and horizontal directions.

According to an exemplary aspect of the invention, an ink chamber is formed so as to store the ink in a lower part thereof and leave a space that does not contain the ink in an upper part thereof, in a state that the ink cartridge is installed in the inkjet recording apparatus. In the ink chamber, at least one part of the upper part at which the space is formed is formed by a transparent or semi-transparent material. In addition, mesh-shaped dispersing grooves are provided on the inner wall surface of the transparent or semi-transparent part, which is designed to hold the ink on the inner wall surface by capillary action in a state that the ink is dispersed in vertical and horizontal directions.

According to an exemplary aspect of the invention, when an ink cartridge is transported or installed in the inkjet recording apparatus, the ink moves inside the ink chamber and always adheres on the internal surface on which the dispersing grooves are formed, and is held by the capillary action in the state that ink is dispersed in the vertical and horizontal directions. Therefore, through the transparent or semi-transparent material on which the dispersing grooves are formed, the color of the ink that spread along the dispersing grooves on the inner surface can be accurately recognized. As such, the color of the ink can be recognized, and incorrect installation of the ink cartridge in an inkjet recording apparatus can be prevented.

According to an exemplary aspect of the invention, for an ink cartridge, because the at least one part on which the dispersing grooves are formed is structured by the transparent or semi-transparent material, each color of ink can be respectively stored in commonly manufactured ink cartridges. Therefore, because the parts for manufacturing the ink cartridges can be shared, complicated manufacturing processes, such as manufacturing ink cartridges by selecting covers based on the color of the ink, can be omitted, resulting in an effect that the manufacturing costs can be reduced.

According to an exemplary aspect of the invention, dispersing grooves are formed on an inner wall surface of a lid that is structured to cover the open end at an upper part of the ink cartridge and seal the inside of the ink cartridge. Therefore, the user can recognize the ink by viewing the lid from the top when installing the ink cartridge to the inkjet recording apparatus, and thus, incorrect installation of the ink cartridge is accurately prevented.

According to an exemplary aspect of the invention, a lid is provided with a gripping part projecting outwardly from the lid for installing the ink cartridge to the inkjet recording apparatus, and the dispersing grooves are formed on an inner wall surface of the gripping part. Because the user installs the ink cartridge by holding the gripping part, the user can accurately recognize the ink in the ink cartridge by viewing the gripping part when installing the ink cartridge. As a result, incorrect installation of the ink cartridge is more accurately prevented.

According to an exemplary aspect of the invention, dispersing grooves are formed in a rectangular mesh shape, a parallelogram mesh shape, or a substantially oval mesh shape. The-dispersion grooves are formed by arranging projecting parts in a rectangular, parallelogram, or substantially oval shape and by forming grooves in the vertical and horizontal directions between the projecting parts. Therefore, because a rectangular, parallelogram, or substantially oval shape is a simple shape, there is an effect in that formation of the dispersion grooves can be achieved easily.

According to an exemplary aspect of the invention, an ink cartridge, by which the ink color in the ink cartridge can be accurately recognized, is installed in the inkjet recording apparatus. Therefore, incorrect installation of the ink cartridge is accurately prevented.

According to an exemplary aspect of the invention, a partition wall is arranged at a substantially intermediate position of the side wall, and a cover is fixed to one side wall. The ink cartridge can thus tolerate the added pressure to the inside from the outside of the ink cartridge. Because of this, in order to suppress the degree of deaeration of the ink cartridge, even when the ink cartridge is contained in a packaging body in a pressure-reduced state, the ink cartridge can suppress damage and deformation. Therefore, it is possible to prevent the ink within the ink chamber from leaking due to deformation and damage of the ink cartridge. At the same time, a situation in which the ink cartridge cannot be mounted to the inkjet recording apparatus due to deformation and damage of the ink cartridge can be prevented.

As discussed above, in Japanese Laid-Open Patent Application 11-58775 for example, in order to suppress the deterioration of deaerated ink, a cartridge is held in a pressure-reduced state within a packaging body. Pressure is applied to the ink cartridge from the outside toward the inside of the ink cartridge. In order to suppression deterioration of deaerated ink, it is necessary to maintain the inside of the packaging body in a vacuum or in a state which is close to a vacuum. A large pressure is thus applied to the ink cartridge from the outside toward the inside.

As described with the above-mentioned ink cartridge, two spaces are formed. A plurality of flat parts are thus used to create the two spaces within the ink cartridge, the ink chamber and the ink supply chamber are aligned in the case with their respective top surfaces open, and the ink chamber has a larger space. As such, the ink cartridge can easily become deformed due to forces applied at the time of pressure reduction. In the case of a relatively small carriage-mounted type ink cartridge, the area of the flat part(s) is small and thus forces applied when the pressure is reduced are tolerated. However, if the conventional ink cartridge is large, the ink cartridge cannot tolerate the pressure. If the shape of the ink cartridge is damaged or deformed, ink leaks from the inside of the cartridge to the outside, and the ink cartridge cannot be normally mounted in an image forming apparatus.

Embodiments of this invention provides for an ink cartridge having a structure that can suppress shape deformation and damage of the ink cartridge in a pressure-reduced state within a packaging body. This invention further provides a packaging body of the ink cartridge that includes an ink cartridge.

In exemplary embodiments, an ink cartridge includes a side wall; a partition wall that divides an inside space surrounded by the side wall at a substantially intermediate position between a first opening and a second opening opposite the first opening, wherein an ink chamber that can store ink is formed between the first opening and the partition wall and a second chamber is formed between the second opening and the partition wall; and a cover that covers the first opening and is fixed to an end surface of the side wall.

In exemplary embodiments, an ink cartridge includes a side wall, of which both opposite end surfaces are respectively open; a partition wall that divides an inside space surrounded by the side wall at a substantially intermediate position between a first opening and a second opening opposite the first opening, wherein an ink chamber that can store ink is formed between the first opening and the partition wall and a second chamber is formed between the second opening and the partition wall; a cover that covers the first opening and is fixed to an end surface of the cylindrical side wall; an ink supply port which is formed in the partition wall and enables communication between the ink chamber and the second chamber; and a valve device which is arranged within the second chamber opposite the ink supply port and selectively allows communication between the ink chamber and an area outside the ink chamber.

In exemplary embodiments, an ink cartridge includes a side wall, of which both opposite end surfaces are respectively open; a partition wall which divides an inside space surrounded by the side wall between a first opening and a second opening opposite the first opening, wherein an ink chamber that can store ink is formed between the first opening and the partition wall and a second chamber is formed between the second opening and the partition wall; an ink supply port which is formed in the partition wall and enables communication between the ink chamber and the second chamber, wherein a first cylindrical part extends into the second opening and surrounds the ink supply port; an air intake opening which is formed in the partition wall and enables communication between the ink chamber and the second chamber, wherein a second cylindrical part extends into the second opening and surrounds the air intake opening; and a wall that extends between the first cylindrical part and the second cylindrical part.

According to an exemplary aspect of the invention, a wall extends in a direction crossing an opening within the second chamber. Thus, even if the pressure is added from the outside to the second chamber side, deformation and damage can be prevented.

According to an exemplary aspect of the invention, rigidity of the side wall of the second chamber side and in the vicinity of the ink supply port can be improved, and the accuracy of connecting the ink cartridge with a device such as an ink jet head or the like can be improved.

According to an exemplary aspect of the invention, a valve device which is arranged opposite to the ink supply port within the cylindrical part and selectively allows communication between the ink chamber and an area outside the ink chamber.

According to an exemplary aspect of the invention, the cylindrical side wall is shaped such that a plurality of substantially partial cylindrical curved walls are arranged in a circumferential direction and concave parts are formed between the curved walls. Therefore, rigidity of the side walls can be improved, and the ink cartridge can tolerate external pressure as described above.

According to an exemplary aspect of the invention, a side wall, the partition wall, and the wall extending in a crossing direction within the second chamber are integrally molded by a resin material. Thus, an ink cartridge with a high rigidity can be easily molded.

According to an exemplary aspect of the invention, even when rigidity of an ink cartridge is improved and pressure-reduced packaging is performed, deformation and damage can be prevented. Furthermore, as the valve device is mounted by using the second chamber, the entire device can be made smaller.

According to an exemplary aspect of the invention, a valve device for air intake can be mounted by using the second chamber, so that the entire device can be made smaller.

According to an exemplary aspect of the invention, rigidity of the side wall of the second chamber side and in the vicinity of the ink supply port can be improved, and accuracy of connection with a device such as an ink jet head or the like to be connected to the inks supply port can be improved. Furthermore, the valve device can be easily mounted with good accuracy by using a cylindrical portion.

According to an exemplary aspect of the invention, a connecting member which interconnects the two cylindrical bodies is further provided, so that rigidity of the side wall of the second chamber side and in the vicinity of the ink supply port can be further improved.

According to an exemplary aspect of the invention, a degree of deterioration can be suppressed, and even if the inside is contained in a packaging member in a pressure-reduced state, deformation and damage of the ink cartridge can be prevented.

While this invention has been described in conjunction with the exemplary embodiments and examples outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An ink cartridge, comprising:

an ink chamber;

a communication chamber through which the ink chamber can communicate with an outside of the ink cartridge;

a valve that is movable;

a support disposed within the communication chamber, the support including a valve seat and an opening exposing a bottom of the valve at an approximately central portion, wherein the valve seat is adjacent to the valve at an outer periphery of the opening; and an urging device that extends from the valve seat, the urging device directly contacting the valve and urging the valve toward the valve seat;

wherein:

the valve separates from the valve seat when a predetermined force is applied to the valve;

the support and the urging device are formed as a one-piece member and are formed separate from the valve; and the valve includes at least one opening so that ink can flow from a top of the valve to a bottom of the valve when the predetermined force is applied to the valve.

2. The ink cartridge according to claim 1, wherein the valve is movable in conjunction with a movement of an extract component that is disposed within the communication chamber and that contacts the valve when the predetermined force is applied to the valve.

3. The ink cartridge according to claim 2, wherein the valve separates from the valve seat when the ink cartridge is attached to an inkjet recording device and the extract component projects from either the inkjet recording device or the valve.

4. The ink cartridge according to claim 3, wherein the extract component is a hollow member that projects from the inkjet recording device and a path is formed so that ink can flow from the ink chamber and into the hollow member when the valve separates from the valve seat.

5. The ink cartridge according to claim 4, wherein the support includes a sealing device that seals an outer circumference of the extract component when the extract component is in contact with the valve.

6. The ink cartridge according to claim 2, wherein the support includes a sealing device that guides the extract component so that the extract component contacts the valve and forms a path so that ink can flow from the ink chamber and into the extract component.

7. The ink cartridge according to claim 1, wherein the opening of the valve is non-circular.

8. The ink cartridge according to claim 1, wherein:

the valve includes a base adjacent the valve seat and a valve sidewall that extends from an outer periphery of the base toward the ink chamber, and the opening of the valve is formed at the base and the valve sidewall.

9. The ink cartridge according to claim 1, wherein individual edge lines define the opening of the valve and are on two or more planes inclined with respect to each other.

10. The ink cartridge according to claim 9, wherein the valve includes a projection protruding from one side of the opening of the valve adjacent the ink chamber side, and edge lines of the projection and the edge lines of the opening are on the two or more planes.

11. The ink cartridge according to claim 1, wherein:

the valve includes a base adjacent the valve seat, and a valve sidewall extends from an outer periphery of the base toward the ink chamber, and the urging device extends along an outer periphery of the valve sidewall.

12. The ink cartridge according to claim 1, wherein when a predetermined force is applied to the valve, a path is created between the ink chamber and an area outside the ink cartridge.

13. The ink cartridge according to claim 1, wherein a thickness of the urging device at an outer periphery of the valve and in a direction perpendicular to an axial direction of the opening is smaller than a thickness of the valve seat in a direction of the predetermined force.

14. The ink cartridge according to claim 2, wherein the support includes:

an inner peripheral wall and an outer peripheral wall located outside the inner peripheral wall, the outer peripheral wall is secured to an inner peripheral wall of the communication chamber, the inner peripheral wall seals an outer surface of the extract component when the extract component is located at the support, a part of the inner peripheral wall is located a predetermined distance away from the outer peripheral wall, and the inner peripheral wall is elastically deformable with respect to the outer peripheral wall.

15. The ink cartridge according to claim 14, wherein the inner peripheral wall defines the opening of the support and size of a part of the opening decreases toward an end adjacent the valve.

16. The ink cartridge according to claim 14, wherein the inner peripheral wall defines the opening of the support and a size of a part of the opening increases toward an end adjacent the valve.

17. The ink cartridge according to claim 1, wherein the valve includes an annular projection that is adjacent the valve seat.

18. The ink cartridge according to claim 1, wherein the urging device includes a projection that engages the valve and obstructs relative motion of the valve in a radial direction.

19. The ink cartridge according to claim 1, wherein:

the support includes an attachment part that projects outward in a radial direction, the communication chamber includes a housing with a stepped surface, and the stepped surface maintains a position of support relative to the communication chamber when the attachment part is inserted in the housing.

20. The ink cartridge according to claim 1, further comprising:

an air communication chamber that is capable of communicating with the ink chamber;

a second valve that is movable;

a second support disposed within the air communication chamber, the second support including a second valve seat and a second opening exposing a bottom of the second valve at an approximately central portion, wherein the second valve seat is adjacent to the second valve at an outer periphery of the second opening; and a second urging device that extends from the second valve seat, the second urging device directly contacting the second valve and urging the second valve toward the second valve seat;

wherein the second valve separates from the second valve seat when a predetermined force is applied to the second valve and the second support and the second urging device are formed as a one-piece member.

21. The ink cartridge according to claim 1, wherein the support and the urging device are formed from a rubber-like elastic material.

22. An inkjet recording apparatus, comprising:

a mounting part that mounts the ink cartridge according to claim 1; and a recording device that receives ink from the ink cartridge and records an image on a recording medium.

23. An ink cartridge, comprising:

an ink chamber that can store ink;

a communication chamber with a first opening that communicates with the ink chamber and a second opening that can receive an extract component;

a valve that is positioned between the first opening and the second opening; and a support that supports a bottom surface of the valve and urges a top surface of the valve toward the second opening;

wherein:

the support is formed as a one-piece member; and the valve includes at least one opening so that ink can flow from a top of the valve to a bottom of the valve when a predetermined force is applied to the valve.

24. The ink cartridge according to claim 23, wherein grooves are formed at approximately even intervals at an outer circumference of the valve.

25. The ink cartridge according to claim 24, wherein the ink is supplied to the top surface of the valve before the second opening receives the extract component.

26. An inkjet recording apparatus, comprising:

a mounting part that mounts the ink cartridge according to claim 23; and a recording device that receives ink from the ink cartridge and records an image on a recording medium.

27. A method of supplying ink from an ink cartridge with a valve that is movable, a support that includes a valve seat and an opening exposing a bottom of the valve at an approximately central portion with the valve seat adjacent the valve at an outer periphery of the opening, and an urging device that extends from the valve seat with the urging device directly contacting the valve and urging the valve toward the valve seat, the support and urging device being formed separate from the valve, the valve including at least one opening so that ink can flow from a top of the valve to a bottom of the valve when a predetermined force is applied to the valve, the method comprising:

moving an extract component into contact with the bottom of the valve; and applying the predetermined force to the valve such that the valve moves away from the valve seat and a top of the urging member flexes outwardly relative to a bottom of the urging member.

* * * * *